US009446424B2

(12) United States Patent
Mathiez

(10) Patent No.: US 9,446,424 B2
(45) Date of Patent: Sep. 20, 2016

(54) PACKAGING, DISPENSING AND USE OF CONTENTS HAVING A LIQUID TO PASTY CONSISTENCY

(75) Inventor: Jean-Louis Mathiez, Limours (FR)

(73) Assignee: CINQPATS, Limours (FR)

( * ) Notice: Subject to any disclaimer, the term of this patent is extended or adjusted under 35 U.S.C. 154(b) by 274 days.

(21) Appl. No.: 13/978,246

(22) PCT Filed: Dec. 30, 2011

(86) PCT No.: PCT/FR2011/053212

§ 371 (c)(1),
(2), (4) Date: Jan. 17, 2014

(87) PCT Pub. No.: WO2012/093222

PCT Pub. Date: Jul. 12, 2012

(65) Prior Publication Data

US 2014/0124541 A1 May 8, 2014

(30) Foreign Application Priority Data

Jan. 3, 2011 (FR) ..... 11 50025

(51) Int. Cl.

| | |
|---|---|
| ***B05B 11/04*** | (2006.01) |
| ***A45D 34/04*** | (2006.01) |
| ***B65D 83/00*** | (2006.01) |

(Continued)

(52) U.S. Cl.

CPC ..... *B05B 11/04* (2013.01); *A45D 34/04* (2013.01); *B05B 11/0072* (2013.01); *B05B 11/3028* (2013.01); *B05B 11/3032* (2013.01); *B05B 11/3081* (2013.01); *B05B 11/3084* (2013.01); *B05B 11/3085* (2013.01); *B65B 3/04* (2013.01); *B65D 83/0033* (2013.01);

(Continued)

(58) Field of Classification Search

CPC combination set(s) only.
See application file for complete search history.

(56) References Cited

U.S. PATENT DOCUMENTS

| | | | |
|---|---|---|---|
| 5,125,539 | A | 6/1992 | Schneider |
| 5,197,637 | A | 3/1993 | Naumann |

(Continued)

FOREIGN PATENT DOCUMENTS

| | | |
|---|---|---|
| EP | 0 380 183 | 8/1990 |
| EP | 0 452 260 | 10/1991 |

(Continued)

OTHER PUBLICATIONS

International Search Report dated Apr. 20, 2012, corresponding to PCT/FR2011/053212.

*Primary Examiner* — David Walczak
(74) *Attorney, Agent, or Firm* — Young & Thompson

(57) ABSTRACT

A device for packaging, dispensing and using fluid contents having a liquid to pasty consistency, includes: a container having, at its front portion, a downstream opening, an element for conveying the contents including an upstream opening, an axially extended passage and a front downstream opening for dispensing the contents, the passage being elastically deformable and capable of being in an idle state having a maximum interior volume or in a compressed state having a smaller interior volume, an upstream valve element, a downstream valve element, a front wall, wherein is situated the front downstream dispenser opening, a movable annular actuating element associated with the passage of the conveying element and consisting of an elastically deformable annular side wall, which limits the passage laterally and externally. The side wall is positioned on the outside and includes an outer side wall of the device, which is at least partially accessible for actuating.

31 Claims, 10 Drawing Sheets

(51) Int. Cl.
*B65B 3/04* (2006.01)
*A45D 40/24* (2006.01)
*B05B 11/00* (2006.01)

(52) U.S. Cl.
CPC ..... *A45D 40/24* (2013.01); *A45D 2200/055* (2013.01); *B05B 11/007* (2013.01); *B05B 11/0048* (2013.01)

(56) References Cited

U.S. PATENT DOCUMENTS

| | | | | |
|---|---|---|---|---|
| 5,377,880 | A * | 1/1995 | Moretti | B65D 83/0033 222/207 |
| 5,738,067 | A | 4/1998 | Landwehr et al. | |
| 5,862,955 | A * | 1/1999 | Albini | B05B 11/0048 222/212 |
| 5,971,224 | A * | 10/1999 | Garibaldi | B05B 11/0048 222/207 |
| 6,070,763 | A | 6/2000 | Gueret | |
| 6,688,317 | B2 | 2/2004 | Gueret | |
| 6,971,553 | B2 * | 12/2005 | Brennan | B05B 11/0059 222/207 |
| 7,325,707 | B2 | 2/2008 | Bougamont et al. | |
| 7,553,100 | B2 * | 6/2009 | Muhr-Sweeney | B08B 1/00 401/17 |
| 7,648,295 | B2 * | 1/2010 | Fredell | A47L 23/05 401/17 |
| 2002/0071708 | A1 | 6/2002 | Fontanet et al. | |
| 2005/0036823 | A1 | 2/2005 | Butcher et al. | |
| 2006/0124670 | A1 | 6/2006 | Bougamont | |
| 2006/0138174 | A1 | 6/2006 | Bougamont et al. | |

FOREIGN PATENT DOCUMENTS

| | | |
|---|---|---|
| EP | 0 600 286 | 6/1994 |
| EP | 0 930 101 | 7/1999 |
| EP | 0 941 205 | 9/1999 |
| EP | 0 990 594 | 4/2000 |
| FR | 2 659 632 | 9/1991 |
| FR | 2 765 560 | 1/1999 |
| FR | 2 810 859 | 1/2002 |
| FR | 2 844 506 | 3/2004 |
| FR | 2 854 554 | 11/2004 |
| FR | 2 857 652 | 1/2005 |
| WO | 02/02423 | 1/2002 |

* cited by examiner

Figure 11c
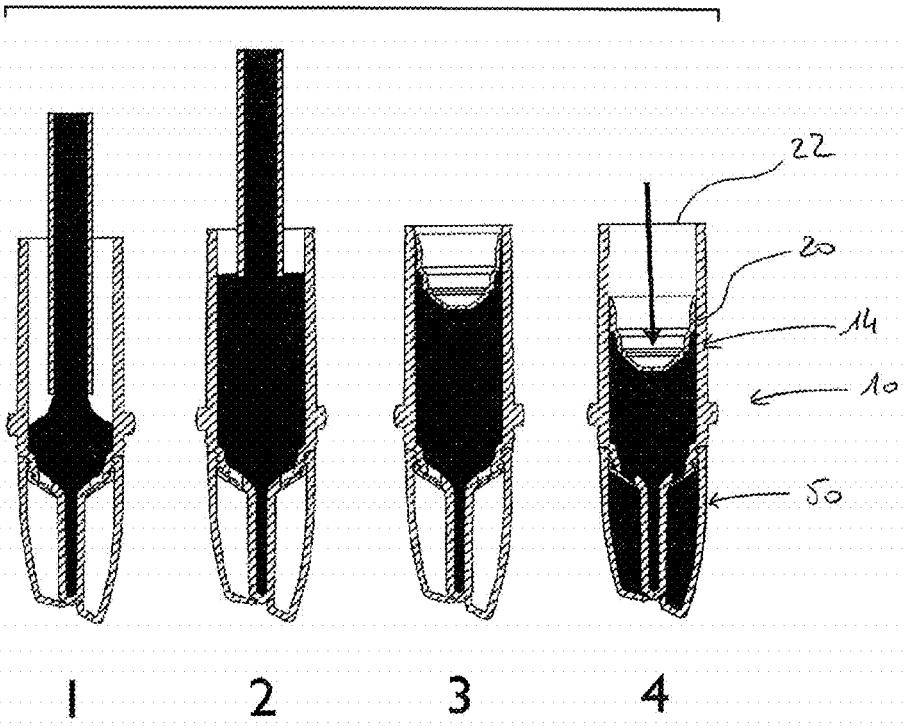
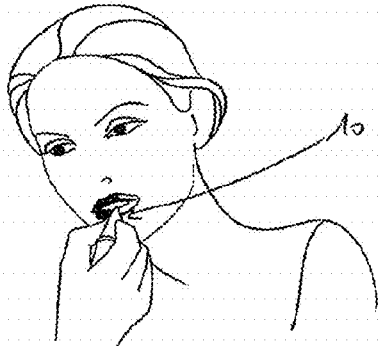
Figure 12a
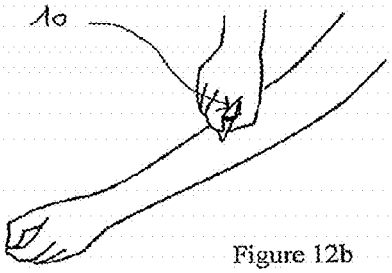
Figure 12b
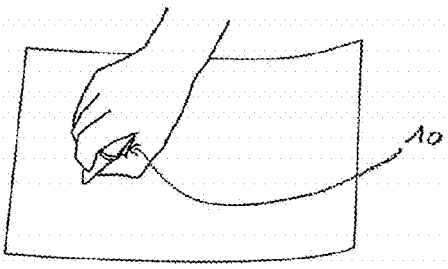
Figure 12c
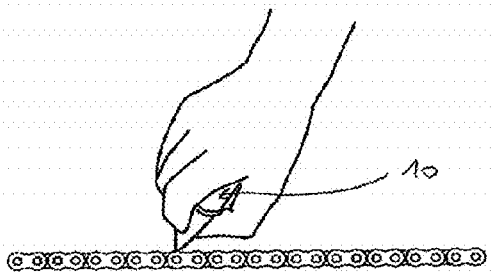
Figure 12d

PACKAGING, DISPENSING AND USE OF CONTENTS HAVING A LIQUID TO PASTY CONSISTENCY

The invention relates to the packaging, dispensing and use of a fluid content having a liquid to pasty consistency.

It more specifically has as its object a combined device for packaging, dispensing, and applying such a fluid content onto a receiving area of a support with which the device is placed in contact and against which it is applied, a component part of such a device comprising a container means and a shaft means, an assembly comprising such a device and an amount of content of a liquid to pasty consistency filling the container, a method for making use of such an assembly for the dispensing and simultaneous application of the content onto said receiving area, and a method for creating such an assembly.

One application of the invention is the packaging, dispensing, and application of a cosmetic product, particularly lipstick. Other applications can also be envisaged for a pharmaceutical product or a skincare product such as an ointment, a cleanser, a cleaning product, a smoothing or stripping product, a product that coats, covers, or is deposited, a preventive or curative treatment product, a decorative product, and more generally a functional product, for which the objective is to simultaneously dispense and apply the content onto a receiving area.

The known devices for packaging and dispensing a fluid content fall into several families.

A first family comprises devices which solely perform the functions of enclosing the content in a container and providing the content via a dispensing opening. After the content has been dispensed, it is used, for example deposited onto a receiving area. During the dispensing of the content, the device, and more specifically its dispensing opening, is distanced from the support that forms the receiving area, so that it is not in contact with it let alone applied against it with any pressure. With such a device of this first family, the dispensing of the content is independent of the support forming the receiving area and does not have to take into account the constraints imposed by contact with and application onto the support forming the receiving area, such as some obscuring of the dispensing opening. Devices for packaging and dispensing a fluid content in this first family are illustrated for example in documents EP-A-0600286 (see FIG. 2 specifically), EP-A-0452260, EP-A-0990594, FR-A-2659632, and EP-A-0930101 (see FIG. 4 specifically).

Concerning document EP-A-0600286, the front (or forward) wall of the corresponding dispensing device where the dispensing opening is located is not intended to come into contact with the receiving area onto which the content is deposited as it exits the dispensing opening, and moreover it cannot be, as the movable actuating means of this device for dispensing the content consists of the front wall and therefore the content is dispensed before its application. The dispensing occurs by the user pressing a finger onto the front wall in a generally axial direction towards the back of the device. The positive pressure created inside the compression chamber is by necessity somewhat limited, which may be acceptable in the context of such a device but would not allow it to fulfill the function of applying the content onto the receiving area as well.

A second family includes devices which perform the functions of enclosing the content in a container and dispensing it in a sponge applicator of a certain transverse and axial size which can be applied onto a receiving area. Devices in this second family are illustrated for example by document EP-A-0380183. With such a device, once it has been used for the first time, content continuously remains in the sponge applicator, which may be acceptable for content such as shoe polish but is unacceptable for content such as a cosmetic product, particularly lipstick. Also, the shape and dimensions of the applicator make such a device inappropriate for lipstick.

The invention does not concern the packaging and dispensing devices of the first or second family, but relates to devices which combine packaging, dispensing, and application, in a third family which includes devices providing all the functions of enclosing the content in a container, dispensing, and applying the content onto a receiving area with which the device is placed in contact and against which it is applied with a certain pressure, the dispensing and application being performed simultaneously. Such devices are typically applicable to lipstick and can sometimes be identified by the terms "sticks", "applicator wand dispenser", "flexible applicator tube", "pump dispenser", and "airless dispenser".

In the context of the third family just described, document U.S. Pat. No. 5,738,067 discloses a container for cosmetic products, in this case lipstick, which includes a container comprising in its front portion a nozzle with a downstream opening and with a sliding piston mounted in its back part. This container also includes a means for guiding the content, extending out from the front of the container, comprising an upstream opening, a passage extending axially, and a front downstream opening for dispensing the content. In a first embodiment, the passage is central, and in a second embodiment, the passage is off-center and lateral. In both cases, the passage is elastically deformable and able to be in a rest state with a maximum internal volume or in a compressed state with a smaller internal volume.

This container also includes an upstream valve, placed between the downstream opening of the container and the upstream opening of the conveying means, and a downstream valve, associated with the front downstream dispensing opening, which is located in a front wall angled relative to the axis. In the teachings of document U.S. Pat. No. 5,738,067, the downstream valve comprises a wall having a contact surface onto which the cosmetic product is to be deposited, which comprises the front downstream dispensing opening, and a valve disk supported by a stem which, in a first embodiment, snap-fits into the end of the central passage of the content conveying means and, in the second embodiment, snap-fits into an off-center and lateral part arranged next to the passage.

Thus when the valve is open, the cosmetic product passes over the edge of the contact surface. This container also includes a movable actuation element, associated with the passage of the conveying means, consisting of an elastically deformable side wall laterally and externally delimiting the passage. In the first embodiment, a side pushbutton acts on a localized part of the wall of the central passage which is held in place on the opposite side by part of the container. In the second embodiment, there is direct action on the external side part of the wall of the passage held in place on the opposite side by the off-center and lateral part into which the supporting stem of the valve disk of the downstream valve is snap-fit. Thus, in either embodiment, the part of the side wall of the passage on which the actuation element acts is located in a circle sector of the container of very limited area. Similarly, the actuation element is located in a circle sector of very limited area of the annular container. In either embodiment, the side wall of the passage, or even the part of the side wall of the passage on which the actuation element acts, is placed inside the container, in the first embodiment behind the pushbutton, and in the second embodiment behind an external wall of the container. In no case does the side wall of the passage, or even the part of the side wall of the passage on which the actuation element acts, constitute the external side wall of the container. Lastly, the side wall of the passage and the front wall belong to two completely distinct parts although they are assembled together in the finished container.

A container with this structure therefore comprises the following seven parts: the container, the sliding piston, the upstream valve, the passage, the downstream valve (which is a composite part including the valve disk and the supporting stem), a lateral supporting part of the wall of the passage opposite the actuation, arranged internally, and an external part in which is arranged the front downstream opening for dispensing the content. A container of this structure also comprises a front downstream opening for dispensing the content that is annular and lateral.

Document US-A-2002/071708 describes a container for a fluid cosmetic product comprising a hollow bodied container and a dispenser head having a deformable top portion which actuates a pump in order to extract a certain amount of cosmetic product from the hollow bodied container and convey it through an aperture to a dispensing head.

This embodiment has disadvantages, firstly because manipulating the deformable top portion is difficult and using the container is therefore not very pleasant for the user, and secondly, the amount of cosmetic product expelled through the opening in the dispensing head is poorly controlled which in some cases results in having to pump the head multiple times and in other cases in having to manually discard the excess product expelled.

Document EP-A-0 941 205 describes a container for cosmetic products, comprising: a hollow housing defining a chamber having a portion of variable volume filled with product and an open dispensing end, a product feed system including a piston, a hollow applicator, and a hand wheel which moves the piston in order to reduce the variable volume and thus eject product through the open dispensing end and the hollow applicator.

Documents FR-A-2 765 560, FR-A-2 810 859, FR-A-2 844 506, FR-A-2 854 554, FR-A-2 857 652, US-A-2005/036 823 relate to various implementations of containers for packaging and dispensing a liquid or pasty product, comprising a solid container and an internal piston movable in the axial direction of the container that is displaced in order to chase the product into one or more channels arranged in an applicator tip.

Document FR-A-2 765 560 describes a product container fitted with a dispensing head, comprising an axially movable button that can be displaced, by pumping, from a bottom position to a top position which causes the product to exit through a distribution valve.

These various implementations have several disadvantages. First, manipulating a movable member in order to displace a piston so that a certain amount of fluid is extracted from the container is impractical because it requires handling the container with two hands, therefore requiring the user first to release a small amount of product from the container and then to apply this small amount of product onto the desired area. Also, these implementations propose the use of dispensing heads equipped with discharge openings which means that the product contained in the container is systematically in contact with the air when the container is not capped, which does not keep the cosmetic product properly packaged.

In this context, the problem underlying the invention is to propose a combined device for packaging, dispensing, and application of content onto a receiving area, its general type being of the third family described and illustrated above, which firstly allows dispensing the desired dose of content through a dispensing opening and simultaneously applying it onto the receiving area, where necessary while moving the device over the area in question, with the user herself able to judge the distribution pressure that he or she needs to apply with the fingers to ensure that the desired amount of content is expelled from the container, even while a contact and application area of its front wall, where the dispensing opening is located, is in contact with and is applied against the receiving area, the user being able to squeeze the device between his or her fingers with the appropriate sufficient pressure. Secondly, it contains or at least may contain a minimum number of parts, with the inherent advantages in terms of cost, ease and speed of assembly, and resistance. Thirdly, it contains or at least may contain a front downstream opening for dispensing content that is generally punctiform, arranged in the middle part of the front wall where it is located.

Therefore, in a first aspect, an object of the invention is a combined device for packaging, dispensing, and application of a fluid content of liquid to pasty consistency onto a receiving area, having a general axis and comprising:

- a container means comprising a downstream opening in its front portion,
- a content conveying means, extending from the front portion of the container means, comprising an upstream opening, an axially extending passage, and a front downstream opening for dispensing the content, the passage being elastically deformable and able to be in a rest state having a maximum internal volume or in a compressed state having a smaller internal volume,
- an upstream valve means, placed between the downstream opening of the container means and the upstream opening of the conveying means,
- a downstream valve means, associated with the front downstream dispensing opening,
- a front wall where the front downstream opening for dispensing the fluid content is located, suitable for and intended to be placed in contact with and applied against the receiving area onto which the content exiting the front downstream dispensing opening is deposited, said front wall extending in a generally transverse direction and having an outside face forming a contact and application area of the device,
- an actuating means that is movable by pressure from the user's fingers in a generally transverse direction, said means being associated with the passage of the conveying means and consisting of an elastically deformable side wall extending in a generally axial direction laterally and externally delimiting the passage located rearwards of the front wall so as to be accessible to the user's fingers when the device is in contact with and applied against the receiving area in order to dispense and apply the content.

In the invention:

- the movable actuating means and the side wall, generally cylindrical or pseudo-cylindrical in shape or inscribed within an envelope that is generally cylindrical or pseudo-cylindrical in shape, are annular with an enclosed outside contour, the side wall is external and constitutes an external side wall of the device at least partially accessible to the user's fingers for actuation, such that it constitutes the movable actuating means, the side wall and the front wall are part of a same content dispensing and application member which comprises, towards the rear, the upstream opening of the content conveying means.

In the invention, when the device is in contact with and applied against the receiving area by the contact and application area of its front wall, the user can press his or her fingers on the side wall/actuating means with the appropriate pressure so that the desired dose of content is dispensed through the dispensing opening and simultaneously applied onto the receiving area. Thus the content is applied onto the receiving area by the contact, in addition with—where necessary—the movement, of the outside face of the front wall of the device over the receiving area.

This arrangement is advantageous in that it allows dispensing the desired dose of content through the dispensing opening and simultaneously applying it onto the receiving area, where necessary while moving the device over the area in question; the user can judge the pressure that needs to be applied to the side wall/actuating means in order to expel the desired amount of content, when the contact and application area of its front wall in which the dispensing opening is located is in contact with and applied against the receiving area, the user being able to squeeze the side wall/actuating means between his or her fingers with the appropriate sufficient pressure. Such an arrangement is also advantageous in that it allows limiting the number of parts to be used to create the actuating means simultaneously ensuring the dispensing and application of the fluid content. This simplifies the manufacture and assembly of the device for packaging, dispensing, and application, which reduces production costs, facilitates production, and improves the assembly speed as well as the resistance of the final device. Also, the combined device for packaging, dispensing, and application implemented in this manner comprises or at least may comprise a front downstream content-dispensing opening that is generally punctiform and arranged in the middle part of the front wall where it is located. This facilitates the application of fluid content by the user and optimizes the obtained precision of the application. To the extent that the side wall and the front wall, although distinct from one another, are part of the same content dispensing and application member, the user awareness of the amount of content released through the dispensing opening is greatly improved. In addition, the configuration of the device allows it to be used whether the dispensing opening is oriented upwards or downwards.

In one embodiment, the downstream valve means comprises an obstructing member cooperating with the front downstream dispensing opening arranged in the front wall, one among the obstructing member and the front wall having a certain flexibility, the other a certain rigidity, which improves the obstruction by more cleanly stopping the release of fluid content through the front downstream dispensing opening and by improving the fluidtightness of the device for packaging, dispensing, and application when the movable actuating means is not actuated.

In one embodiment in which the device comprises an obstructing member, the latter cooperates with the front downstream dispensing opening and is located on the internal upstream side of the front wall, without protruding outside the device through the front downstream dispensing opening. Thus the obstructing member is invisible or practically invisible and imperceptible or practically imperceptible to the user, particularly when the front wall is applied against an area of the body. In addition, this arrangement offers advantages in terms of hygiene because it prevents the presence of residual product in the opening which avoids bacterial contamination and/or oxidation. It is thus possible to reduce the use of anti-oxidants and preservatives in the content formula.

In one embodiment in which the device comprises an obstructing member, the latter is in the form of a nipple or plate, which facilitates their manufacture.

In one embodiment in which the device comprises an obstructing member, said obstructing member of the downstream valve means is a rigid nipple forming the front terminal portion of a shaft means, arranged in the axial direction. Such an arrangement assures that the front wall is sealed off without encumbering the axially extending passage of the content conveying means and without interfering with the manipulation of the movable actuating means.

In this case, in one embodiment the container means and the shaft means are parts of a same piece, being arranged axially each as an extension of the other, at the front portion of the container means and at the rear base of the shaft means, the front downstream dispensing opening being substantially punctiform and arranged in the middle part of the front wall. This configuration allows performing the functions of containing the fluid content and of obstructing the front downstream dispensing opening while limiting the number of parts to be made and assembled.

In this case, in one embodiment the container means is of a larger size radially than the shaft means, and a transverse shoulder connects the front portion of the container means and the rear base of the shaft means, the downstream opening of the container means being arranged in said transverse shoulder, which simultaneously provides minimum bulk and simplified production.

In one embodiment, the downstream valve means is formed by the front wall where the front downstream dispensing opening is located, the front wall being elastically deformable and able to close the front downstream opening when there is no external force applied or negative pressure upstream, and to open the front downstream dispensing opening when there is positive pressure upstream. The creation of an additional part, in this case the obstructing member, is thus avoided and the device for packaging, dispensing, and application is simplified.

In one embodiment, the side wall and the front wall form a single piece.

In an alternative embodiment, the side wall and the front wall form two parts of one piece.

In one embodiment, the front wall in which is located the front downstream dispensing opening extends transversely and at an angle to the axis of the device, similar to the shape of a lipstick tip.

In one embodiment, the outside face of the front wall forming the contact and application area of the device is either flat or slightly rounded or outwardly concave or outwardly convex, which facilitates applying the fluid content uniformly onto a receiving area that is of a substantially complementary shape.

In one embodiment, the outside face of the front wall forming a contact and application area of the device has raised and recessed relief elements such as dots, lines, ribs, or similar. This allows obtaining a predetermined rendering adapted for the receiving area.

In one embodiment, the outside face of the front wall forming a contact and application area of the device either slides or is made to slide, or rubs or is made to rub.

In one embodiment, the outside face of the front wall forming a contact and application area of the device has a certain superficial flexibility or is made to have a certain superficial flexibility.

In one embodiment, the outside face of the front wall forming a contact and application area of the device either bears a coating or decoration, or has been the object of a surface treatment.

In one embodiment, the combined device for packaging, dispensing and application additionally comprises, before its first use, an initial protection means and/or an initial integrity indicator means on the outside face of the front wall forming a contact and application area for the device on the receiving area.

In one embodiment, the front downstream dispensing opening is substantially punctiform and is arranged in the middle part of the front wall.

In one embodiment, the front downstream dispensing opening is linear in shape and/or comprises several openings and/or is formed by the porous structure of the front wall.

In one embodiment, the elastic deformability of the side wall of the content dispensing and application member results from the chosen limited thickness and/or from the chosen elastically deformable material of the side wall.

In one embodiment in which the combined device for packaging, dispensing and application comprises a shaft means, the passage of the conveying means has a transverse cross-section that is annular in shape, delimited by an enclosed outside contour and an enclosed inside contour corresponding to the shaft means.

In one embodiment in which the combined device for packaging, dispensing, and application does not include a shaft means, the passage of the conveying means has a transverse cross-section delimited by an enclosed outside contour.

In one embodiment, the container means is arranged so that the discharge of an amount of content is compensated for without admitting any air, which prevents feed failure in the device and any bacterial contamination and oxidation of the content.

In one embodiment, the container means comprises a rigid tubular part and a piston mounted in the rigid tubular part, between them fluidtight to the content, the piston being gradually movable from the rear portion to the front portion of the rigid tubular part as the rigid tubular part is emptied of content.

In this case, the rigid tubular part comprises an open rear edge which allows introducing the piston into the rigid tubular part after the fluid content is introduced into the container means.

In one embodiment, the container means is formed by a deformable wall such as a bag, a bottle with internal bag, or a tube.

In one embodiment, the combined device for packaging, dispensing, and application additionally comprises a part serving as a basic body which houses and to which is attached the container means, the part serving as a basic body and the container means comprising rigid mutual association means.

In one embodiment, the content dispensing and application member and the container means are arranged axially each as an extension of the other, at the front portion of the container means and at the upstream opening of the content conveying means, the content dispensing and application member and the container means comprising rigid mutual association means. This configuration enables the combined device for packaging, dispensing, and application to have a smaller size radially.

In one embodiment, the combined device for packaging, dispensing, and application additionally comprises a cap means suitable for being detachably assembled onto the container means or onto the part serving as a basic body.

The invention also concerns a combined device for the packaging, dispensing and application of two fluid contents of liquid to pasty consistency, comprising two basic devices of the invention, arranged end to end, the two container means being adjacent and the two front downstream openings for dispensing the two contents being opposite one another.

The invention additionally concerns a device for the packaging, dispensing, and application of at least two fluid contents of liquid to pasty consistency, comprising at least two basic devices of the invention, arranged side by side in the transverse direction, the at least two container means and the at least two conveying means being distinct and hermetically separated by fluidtight compartment means, the at least two movable actuating means, respectively associated with the passages of the conveying means, consisting of a single elastically deformable side wall laterally and externally delimiting the passages of the at least two conveying means.

Another aspect of the invention concerns a component part of the device of the invention when said device includes a shaft means, comprising a container means and a shaft means, axially arranged each as an extension of the other, at the front portion of the container means and at the rear base of the shaft means, the container means being of larger size radially than the shaft means, wherein a transverse shoulder connects the front portion of the container means and the rear base of the shaft means, the downstream opening of the container means being arranged in said transverse shoulder.

Another aspect of the invention concerns an assembly comprising a combined device for packaging, dispensing, and application as has just been described and an amount of content of a liquid to pasty consistency filling the container.

Another aspect of the invention concerns a method for making use of a combined device assembly for packaging, dispensing, and application of an amount of content as has just been described, in order to dispense and apply content onto said receiving area, wherein:

an assembly is provided in which the container means is filled with content, the upstream valve means and the downstream valve means are respectively closing off the communication between the container means and the passage of the content conveying means and the dispensing opening, and, when one wants to dispense and apply content onto the receiving area:

the contact and application area of the front wall of the device is placed in contact with and applied against the receiving area, the actuating means is biased by the pressing the fingers on the side wall with the appropriate pressure, such that the internal volume of the passage changes from the maximum volume to a smaller internal volume, the dosed dispensing of the content to be applied occurring as it is applied onto the receiving area, thus closing the upstream valve means and opening the downstream valve means in a manner that causes the content to exit through the dispensing opening and simultaneously to be applied onto the receiving area, the biasing of the actuating means is stopped by stopping the pressure of the fingers on the side wall which allows the side wall to return to its initial state, thus closing the downstream valve means and stopping the content from exiting through the dispensing opening and thus opening the upstream valve means which allows an amount of content equivalent to what was dispensed through the dispensing opening to be transferred from the container means to the conveying means, due to the negative pressure generated, Another aspect of the invention concerns a device for the packaging, dispensing, and application of content of a liquid to pasty consistency, comprising:

a container means comprising a downstream opening in its front portion, a content conveying means, extending from the front portion of the container means, comprising an upstream opening, an axially extending passage, and a front downstream opening for dispensing content, the passage being elastically deformable and able to be in a rest state having a maximum internal volume or in a compressed state with a smaller internal volume, an upstream valve means, placed between the downstream opening of the container means and the upstream opening of the conveying means, a downstream valve means, associated with the front downstream dispensing opening, a front wall where the front downstream dispensing opening is located, a movable actuating means, associated with the passage of the conveying means, consisting of an elastically deformable side wall laterally and externally delimiting the passage, characterized by its comprising:

a part comprising:

the container means including a rigid tubular part and a piston mounted in the rigid tubular part, between them fluidtight to the content, the piston being gradually movable from the rear portion to the front portion of the rigid tubular part as the rigid tubular part is emptied of content, and a rigid shaft means, the container means and the shaft means being arranged axially, each as an extension of the other, at the front portion of the container means and at the rear base of the shaft means, a content dispensing and application member which includes the side wall and the front wall, the side wall and the actuating means being annular, the passage of the conveying means having a transverse cross-section that is annular in shape, delimited by an enclosed outside contour corresponding to the side wall and an enclosed inside contour corresponding to the shaft means.

Another aspect of the invention relates to an assembly comprising a combined device for packaging, dispensing, and application as described above and an amount of content of liquid to pasty consistency filling the container.

In one embodiment, the assembly of the invention is intended to be used for packaging, dispensing, and applying a cosmetic product such as lipstick, a pharmaceutical product or a skincare product such as an ointment, a cleansing product, a cleaning product, a smoothing or stripping product, a product for coating, covering, or depositing, a product for preventive or curative treatment, a decorative product, or a functional product.

Another aspect of the invention concerns a method for creating an assembly of a device for packaging, dispensing, and application +content as described above, wherein:

a device is provided in which the part comprising the container means, without the piston, and the content dispensing and application member are assembled together, the container means is filled with content through its rear opening, some of this content is transferred from the container means to the content dispensing and application member by forcing open the upstream valve means due to positive pressure on the content or negative pressure in the front dispensing opening, then the filling of the container means with content is completed, then the piston is placed in the container means.

Another aspect of the invention concerns a method for creating an assembly of a device for packaging, dispensing, and application +content as defined above, wherein:

a device is provided in which the part comprising the container means, without the piston, and the content dispensing and application member are assembled together, the content dispensing and application member is filled with content by forcing open the upstream valve means due to positive pressure on the content or negative pressure in the front dispensing opening, then the container means is filled with content by its open rear edge, then, once the filling of the container means is completed, the piston is placed in the container means.

Another aspect of the invention concerns a method for creating an assembly of a device for packaging, dispensing, and application +content as defined above, wherein:

a device is provided in which the part comprising the container means, without the piston, and the content dispensing and application member are assembled together, the container means is filled with content by its rear opening, then the piston is placed in the container means, then the piston is pushed into the container means so that the content dispensing and application member is filled with content by forcing open the upstream valve means due to the positive pressure on the content that is generated by the advance of the piston.

Other features and advantages of the invention will be apparent from the following description presented for purposes of illustration and not to be taken in a limiting sense, with reference to the accompanying drawings in which:

FIG. 1 is a general exploded perspective view of a first embodiment of the combined device for packaging, dispensing, and application of the invention, FIG. 2 is a general longitudinal cross-sectional view of the first embodiment of the combined device for packaging, dispensing, and application of FIG. 1;

FIG. 3*a* is a general longitudinal cross-sectional view of the first embodiment of the combined device for packaging, dispensing, and application of FIG. 1, illustrating the movements of the fluid content dispensing and application member when pressure is exerted on said content, allowing it to be released through the front downstream dispensing opening;

FIG. 3*b* is a general longitudinal cross-sectional view of the first embodiment of the combined device for packaging, dispensing, and application of FIG. 1, illustrating the movements of the fluid content dispensing and application member when said content is at a negative pressure which allows it to pass from the container means to the conveying means;

FIGS. 4*a* to 4*d* are four detailed front views of four variant embodiments of the dispensing and application member which are possible first embodiments of the combined device for packaging, dispensing, and application of FIG. 1;

FIGS. 5*a* to 5*d* are four general perspective views representing four distinct embodiments of the combined device for packaging, dispensing, and application according to the invention;

FIGS. 5*e* to 5*h* are four general perspective views representing four distinct embodiments of the container means that is part of the combined device for packaging, dispensing, and application of the invention;

FIGS. 5*i* to 5*l* are four detailed perspective views representing four distinct embodiments of the dispensing and application member that is part of the combined device for packaging, dispensing and application of the invention;

FIGS. 5*m* to 5*o* are three detailed perspective views representing three distinct embodiments of the dispensing and application member that is part of the combined device for packaging, dispensing, and application of the invention, in which the front surface is covered with a surface coating;

FIGS. 5*p* to 5*r* are three general perspective views representing three embodiments of a combined device for packaging, dispensing, and application of the invention, having different external shapes;

Figure 1:
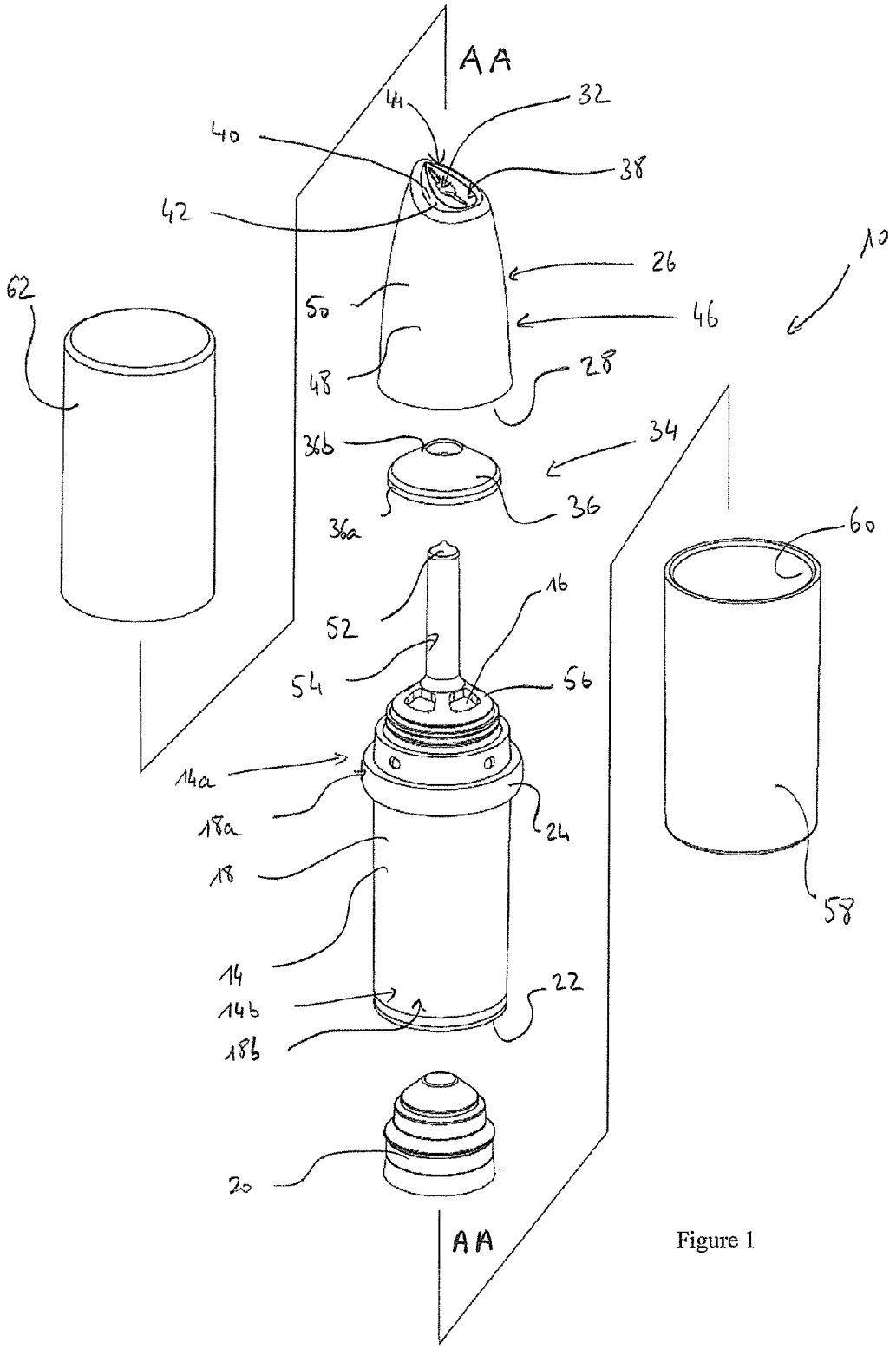
Figure 2:
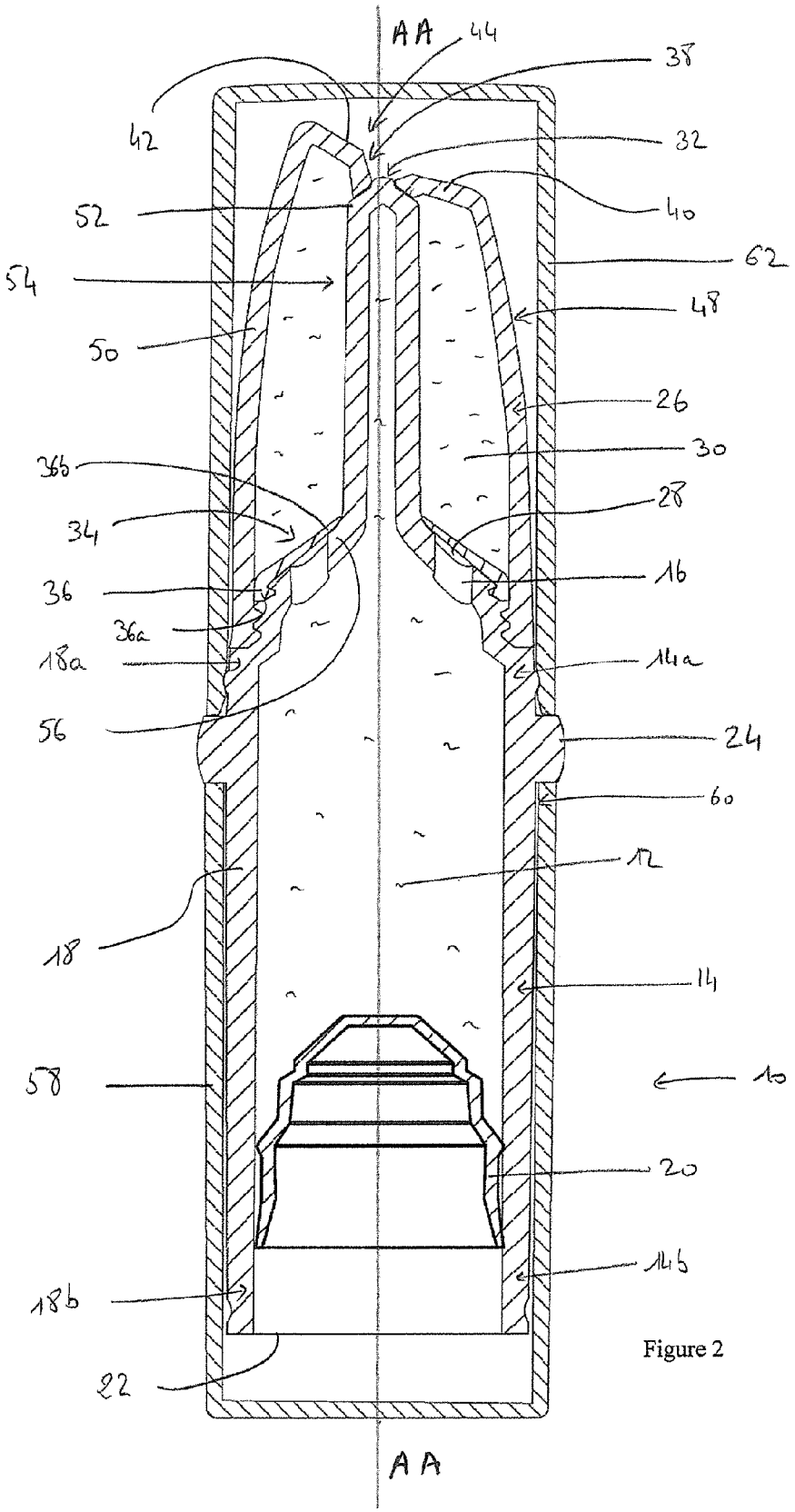
Figure 8:
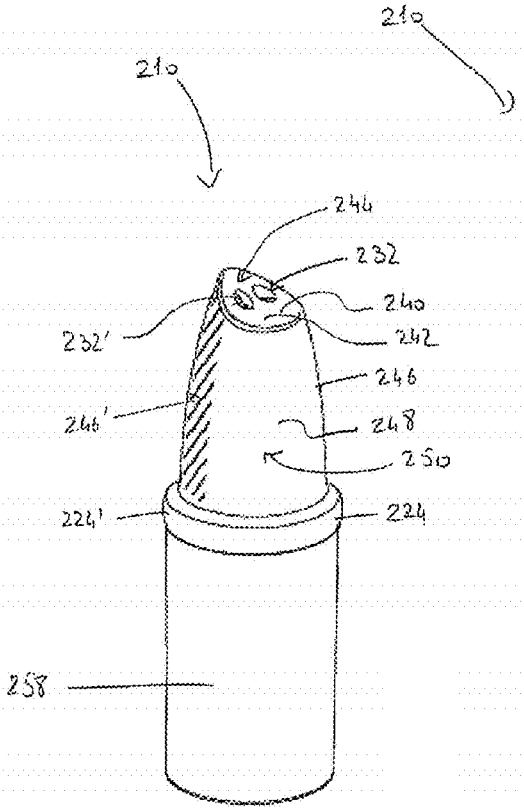
Figure 9:
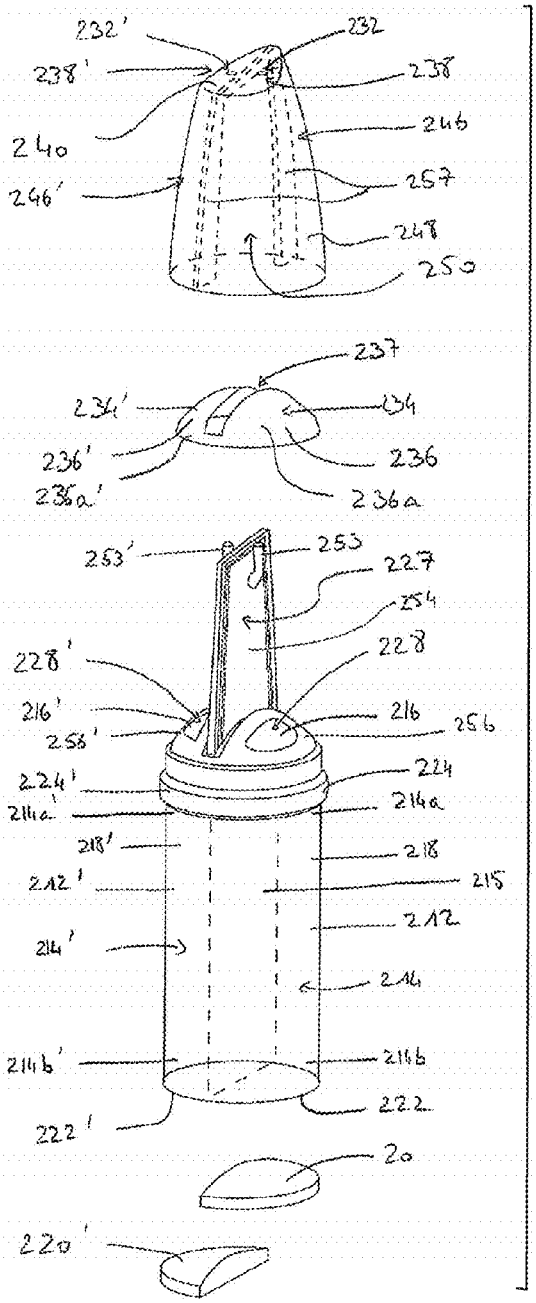
Figure 10A:
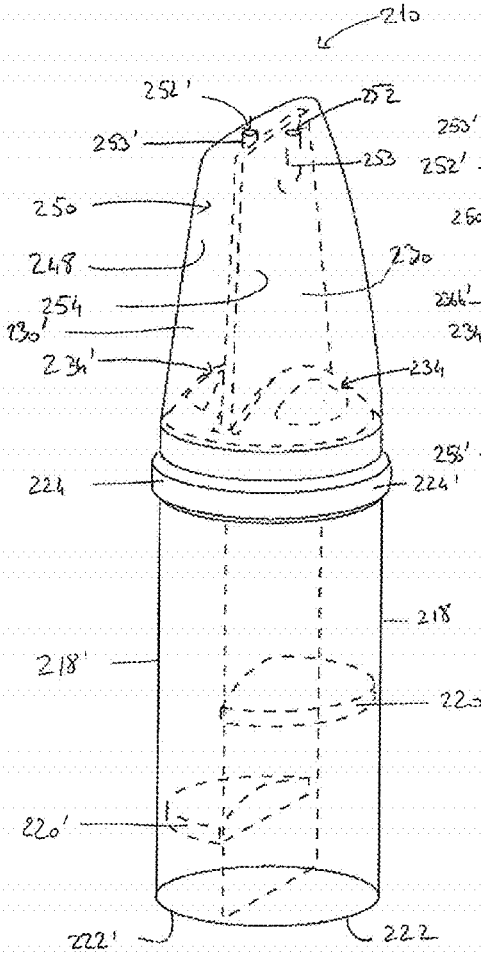
Figure 10B:
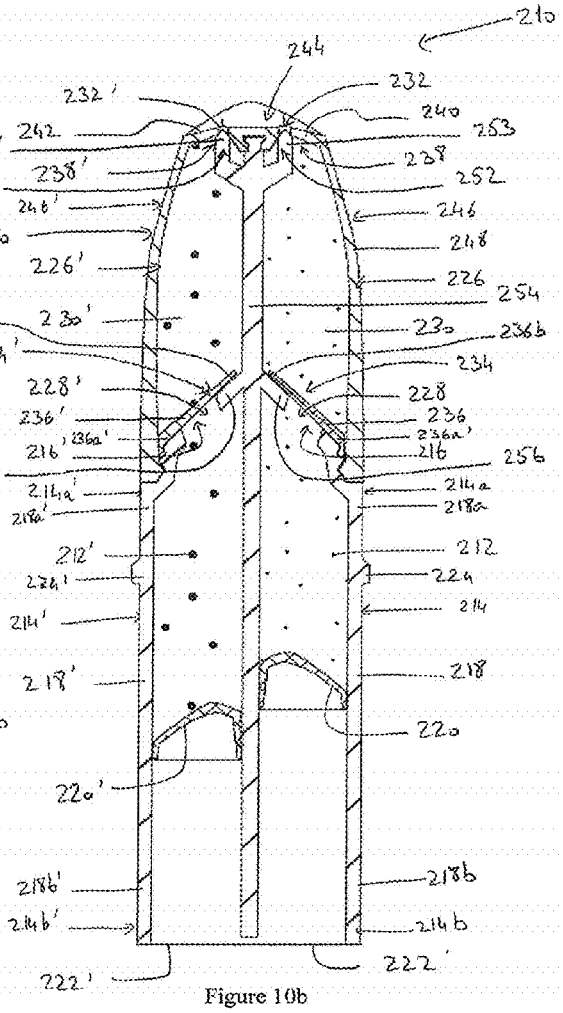
Figure 11A:
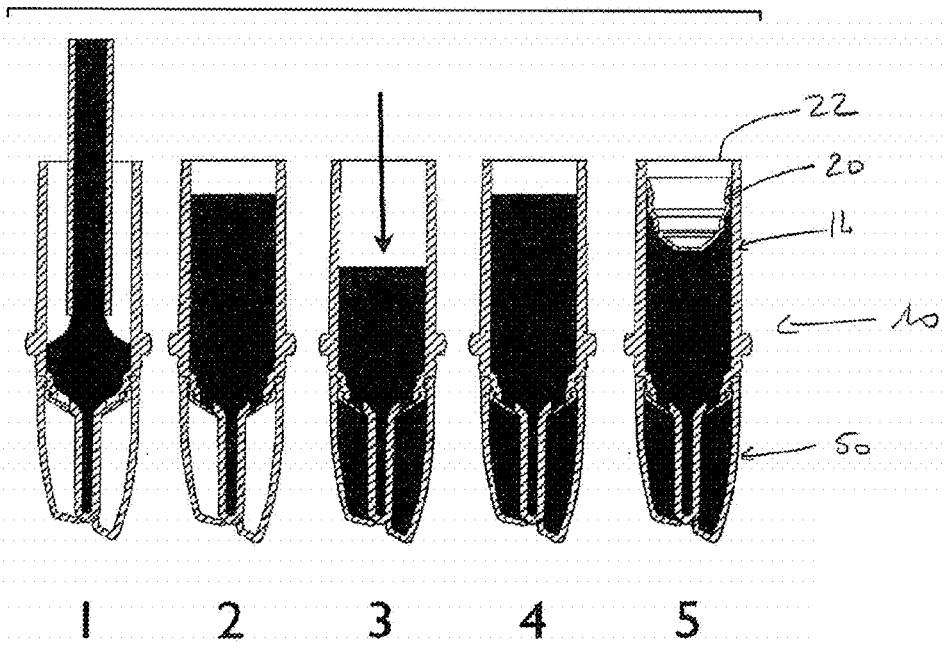
Figure 11B:
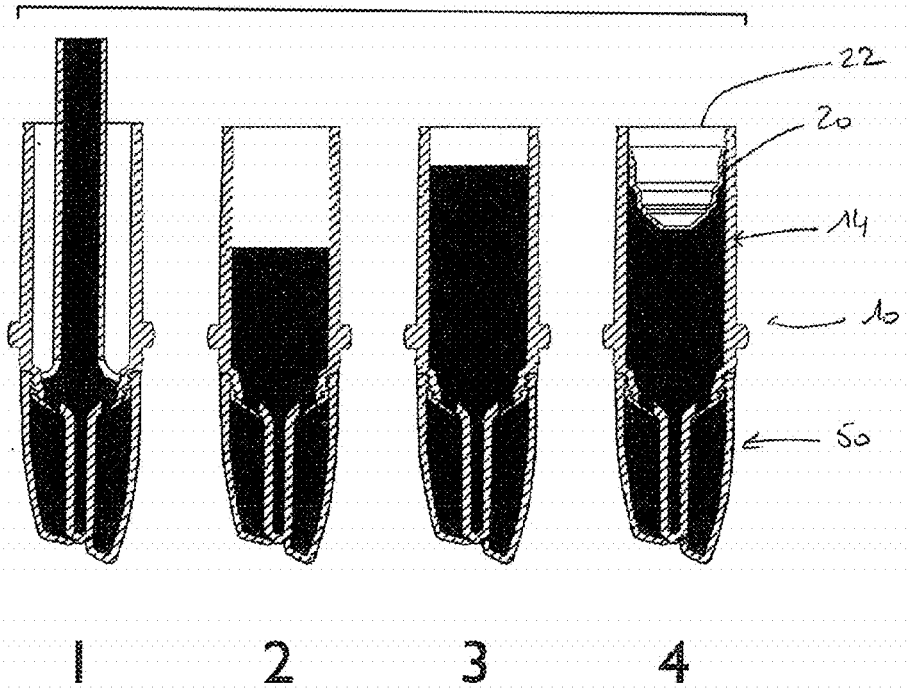

FIG. 8 is a general view of the assembly, in a perspective view, in a third embodiment of the combined device for packaging, dispensing and application, comprising two basic devices of the invention arranged side by side in the transverse direction, the two container means and the two conveying means being distinct and hermetically separated by fluidtight compartment means, while the two movable actuating means respectively associated with the passages of the conveying means are formed by the same single elastically deformable side wall laterally and externally delimiting the passages of the two conveying means;

FIG. 9 is a general exploded perspective view of the third embodiment of the combined device for packaging, dispensing, and application of FIG. 8;

FIG. 10*a* is a general view of the assembly, in a perspective view, its transparency illustrating the third embodiment of the combined device for packaging, dispensing, and application of FIG. 8;

FIG. 10*b* is a general view of the assembly, in a cross-sectional view, of the third embodiment of the combined device for packaging, dispensing, and application of FIG. 8;

FIG. 11*a* is a general cross-sectional view of the first embodiment of the combined device for packaging, dispensing, and application of FIG. 1 during the successive phases of filling said device with fluid content;

FIG. 11*b* is a general cross-sectional view of the first embodiment of the combined device for packaging, dispensing, and application of FIG. 1 during the successive phases of filling it with fluid content;

FIG. 11*c* is a general cross-sectional view of the first embodiment of the combined device for packaging, dispensing, and application of FIG. 1 during the successive phases of filling it with fluid content;

FIGS. 12*a* to 12*d* are four general perspective views illustrating four possible applications of the combined device for packaging, dispensing, and application of the invention, and showing its use by squeezing it between two fingers at two diametrically opposite squeezing areas, at a distance from the front wall.

A first embodiment of the combined device for packaging, dispensing, and application of the invention is now described in detail with reference to FIGS. 1, 2, 3*a* and 3*b*.

This combined device for packaging, dispensing, and application 10 is intended for receiving a fluid content 12 of a consistency which can range from liquid to pasty, such as a lipstick, a pharmaceutical product, a skincare product, an ointment, a cleansing product, a cleaning product, a smoothing or stripping product, a product for coating, covering, or depositing, a preventive or curative treatment product, a decorative product, and more generally a functional product which one wants to apply onto a receiving area of a support at the same time as it is dispensed by the device 10 in contact with, and applied with a certain pressure against, the support in question, which is typically the case for lipstick. It is with this meaning that the term "combined" is to be understood when it applies to the device for packaging, dispensing, and application, the packaging, dispensing and application being done using the device 10 itself.

To achieve this, the combined device for packaging, dispensing, and application 10 which has a generally longitudinal axis AA firstly comprises a container means 14 extending substantially in a longitudinally axial direction and comprising a front portion 14*a* and a rear portion 14*b*, these concepts to be considered as relative.

The container means 14 is suitable for containing a predetermined amount of content 12 in fluidtight conditions assuring an appropriate packaging of said content 12 according to its specific properties.

The front portion 14*a* of the container means 14 is equipped with a downstream opening 16 sufficiently large to allow the content 12 to pass through easily according to its viscosity, with minimum head loss. The container means 14 is arranged such that the discharge of an amount of content 12 through the downstream opening 16 is compensated for without admitting any air, according to a technique known as "Airless."

To achieve this, the container means 14 comprises a rigid tubular part 18—here having a substantially circular cross-section—and a piston 20 mounted inside the rigid tubular part 18, between them being fluidtight to the content 12.

The piston 20 is of a shape and composition such that it is movable from a rear portion 18*b* of the tubular part 18 to a front portion 18*a* of this tubular part 18 as the content escapes from the tubular part 18 through the downstream opening 18.

The rear portion 18*b* of the tubular part 18 has an open rear edge 22 through which the piston 20 can be introduced. When the piston 20 is in position inside the tubular part 18, it establishes the fluidtightness to the content 12 and prevents the content from escaping via the rear edge 22 of the tubular part 18.

It should be noted that in the first embodiment represented in FIG. 1, the component tubular part 18 of the container means 14 is rigid, which requires using the piston 20 to compensate for the content 12 escaping through the downstream opening 16 without admitting any air.

Such an embodiment is advantageous, particularly as the position of the piston 20 allows determining an approximation of the amount of content 12 remaining inside the container means 14. More particularly, a viewing window 24 is arranged in the front portion 14*a* of the container means 14 so that the presence of the piston 20 near this front portion 14*a* is detectable by the user who can then, depending on the type of embodiment, detect the presence of the piston 20 or the absence of content 12 though this viewing window 24.

However, in an alternative embodiment, the container means 14 may be based on a deformable wall such as a bag, a bottle with internal bag, or a tube. In this case, the use of a piston 20 can be eliminated because the negative pressure generated inside the container means 14 when the content 12 escapes through the downstream opening 16 causes a deformation of the deformable wall.

The container means 14 does not necessarily have a transverse cross-section that is circular; it may be rectangular, square, oval, oblong, etc.

The combined device for packaging, dispensing, and application 10 also comprises a conveying means 26.

The conveying means 26 extends the container means 14 out from its front portion 14*a* and comprises an upstream opening 28, a passage 30 extending axially in the longitudinal axial direction, and a front downstream opening 32 for dispensing the content 12.

The passage 30 is elastically deformable and can be in a rest state having a maximum internal volume or in a compressed state having a minimum internal volume. The passage from the rest state to the compressed state causes positive pressure in the conveying means 26, while the passage from the compressed state to the rest state causes negative pressure in the conveying means 26.

The combined device for packaging, dispensing, and application 10 also comprise an upstream valve means 34.

The upstream valve means 34 is placed between the downstream opening 16 of the container means 14 and the upstream opening 28 of the conveying means 26, and performs two main functions. First, this upstream valve means 34 prevents the transfer of content 12 from the conveying means 26 to the container means 14, particularly when the passage 30 passes from the rest state to the compressed state. Second, said upstream valve means 34 can be deformed to unobstruct the downstream opening 16 and allow content 12 to travel from the container means 14 to the conveying means 26 when the passage 30 passes from the compressed state to the rest state thus generating the negative pressure in the conveying means 26.

In the embodiment in FIG. 1, the upstream valve means 34 consists of an annular ring 36 made of a flexible material.

This annular ring 36 is able to completely cover the upstream opening 28 of the conveying means 26 to prevent the transfer of content 12 from the conveying means 26 to the container means 14. The annular ring 36 has a fixed portion 36*a* which remains unmoving on the front portion 18*a* of the tubular part 18 and an unfixed portion 36*b* which can move to allow content 12 to travel from the container means 14 to the conveying means 26, particularly when the passage 30 passes from the compressed state to the rest state generating the negative pressure in the conveying means 26.

It should be noted, however, that the shape, structure, and composition of the upstream valve means 34 can vary according to the embodiments and particularly according to the geometry of the downstream opening 16 of the container means 14 and/or of the upstream opening 28 of the conveying means 26.

The combined device for packaging, dispensing and application 10 also comprises a downstream valve means 38.

This downstream valve means 38 is associated with the front downstream dispensing opening 32 and allows extracting the content 12 accumulated in the passage 30 of the conveying means 26 when the latter passes from the rest state to the compressed state and a positive pressure occurs in the conveying means 26.

In effect, as indicated above, when said passage 30 passes from the rest state to the compressed state, the upstream valve means 34 prevents the content 12 from traveling through the upstream opening 28 of the conveying means 26 into the container means 14. The content 12 is then inevitably forced to move towards the front downstream dispensing opening 32 for discharging to the outside.

The combined device for packaging, dispensing and application 10 also comprises a front wall 40.

This front wall 40 supports and contains the front downstream dispensing opening 32 through which content 12 is released during use of the combined device for packaging, dispensing and application of the invention.

This front wall 40 is thus suitable for and is intended to come into contact with and be applied against the receiving area of a support, onto which the content 12 exiting the front downstream dispensing opening is deposited. To allow this, the front wall 40 extends transversely to the longitudinal axial direction and has an outside face 42 forming a contact and application area 44 of the device. "Contact" is understood to mean that during its use the device 10 touches the support in the receiving area. "Applied against" is understood to mean that during its use the device 10 presses on the support, in the receiving area, with a certain pressure. "Contact" and "applied against" are perfectly understood in reference to lipstick in particular, where the tip is placed against the lips with a certain pressure. Because of this characteristic of the front wall 40, it is understood that it must remain free and accessible to the receiving area of the support during the use of the device 10.

In the embodiment in FIG. 1, the front wall 40 in which the front downstream dispensing opening 32 is located extends transversely at an angle to the longitudinal axis AA of the device 10, thus resembling a lipstick tip and assuring a uniform application of the content 12 onto the corresponding surface of the receiving area.

In this embodiment, the outside face 42 of the front wall 40 forming the contact and application area 44 is slightly curved with its concavity facing outward to allow uniform application of the content 12 onto the receiving area when the latter is itself rounded, as is the case with a lip for example.

It should be noted, however, that in one variant, the outside face 42 of the front wall 40 forming the contact and application area 44 can be flat when the receiving area for the content 12 is itself flat. Similarly, it is also possible for said outside face 42 of the front wall 40 forming the contact and application area 44 to be equipped with raised and recessed relief elements such as dots, lines, ribs, or similar, to provide a partial, striped, dotted, etc. application of the content 12 onto the receiving area.

In addition, the outside face 42 of the front wall 40 forming the contact and application area 44 may either slide or be made to slide, or rub or be made to rub. It can also have a certain superficial flexibility or be made to present a certain superficial flexibility, to improve the ease of use and the application of the content 12 onto the receiving area. It can also bear a coating or decoration or have been the object of a surface treatment, for the same reasons.

It should be pointed out that the front downstream dispensing opening 32 may be substantially punctiform and be arranged in the middle part of the front wall 40 or may be linear in form.

This front downstream dispensing opening 32 may even comprise several openings and/or be formed by the porous structure of the front wall.

In all cases, the outside face 42 of the front wall 40 plays several roles. It bears the front downstream dispensing opening 32. It serves to be placed in contact with and be applied against the receiving area of the support which, among other functions, defines the exact location where the content is to be applied. It applies the content onto the receiving area after contact, in addition with—where necessary—the movement of the outside face 42 of the front wall 40 over the receiving area.

The combined device for packaging, dispensing, and application 10 also comprises an actuating means 46, movable by the user pressing his or her fingers in a generally transverse direction.

The movable actuating means 46 is associated with the passage 30 of the conveying means 26 and causes said passage 30 to pass from the rest state to the compressed state and vice versa, causing content 12 to be released through the front downstream dispensing opening 32. The movable actuating means 46 consists of an elastically deformable side wall 48 extending in the generally longitudinal axial direction, laterally and externally delimiting the passage 30 of the conveying means 26, located rearwards of the front wall 40 so as to be accessible to the user's fingers when the device 10 is in contact with and applied against the receiving area in order to dispense and apply content. Thus, when the side wall 48 is compressed, it is elastically deformed which causes the passage 30 to pass from the rest state to the compressed state, at the same time generating positive pressure inside the conveying means 26 and therefore causing content 12 to be released through the front downstream dispensing opening 32. When this side wall 48 is no longer squeezed, it elastically returns to its rest state, at the same time generating a negative pressure inside the conveying means 26 and therefore causing the downstream valve means 38 to close.

The elastically deformable nature of the side wall 48 results, for example, from the chosen limited thickness and/or from the chosen elastically deformable material it is made of.

The actuating means 46 and the side wall 48 are generally cylindrical or pseudo-cylindrical or are inscribed within an envelope that is generally cylindrical or pseudo-cylindrical. They are annular with an enclosed outside contour which allows effective and easy use of the combined device for packaging, dispensing, and application 10, by squeezing it between the fingers, particularly in diametrically opposite areas.

The side wall 48 is placed outside the conveying means 26 and at least partially constitutes an external side wall of the device 10, accessible at least for the actuation. As the side wall 48 constitutes the actuating means 46, the user can easily and freely access the actuating means 46 to cause content 12 to be expelled through the front downstream dispensing opening 32.

In addition, the side wall 48 and the front wall 40 are part of a same content 12 dispensing and application member 50, in this case as a single piece, comprising at the rear the upstream opening 28 of the content 12 conveying means 26.

By this particular arrangement, the number of parts to be used is greatly decreased in comparison to the prior art, which results in reduced costs in terms of production and parts assembly and greatly simplifies the device. Such an embodiment, in which the side wall 48 and front wall 40 are part of the same dispensing and application member 50, allows improving user awareness of the amount of content 12 released. The user can thus better judge the pressure to apply on the side wall 48 in order to expel the amount of content 12 required. The application of this content 12 onto the receiving area is thus greatly improved.

The content 12 dispensing and application member 50 and the container means 14 are arranged axially, each as an extension of the other, at the front portion of the container means and at the upstream opening of the content conveying means.

Also, the content 12 dispensing and application member 50 and the container means 14 comprise rigid mutual association means, in this case complementary associating edges which, because of the elasticity of the dispensing and application member 50, maintain said member in position on the upper part 14*a* of the container means 14.

In the embodiment in FIG. 1, provided as a non-limiting example, the downstream valve means 38 comprises an obstructing member 52 cooperating with the front downstream dispensing opening 32 arranged in the front wall 40.

To facilitate the release of content 12 through the front downstream dispensing opening 32, it is useful for the combined device for packaging, dispensing, and application 10 to have an obstructing member 52 and a front wall 40 of which one presents a certain flexibility and the other a certain rigidity.

In the embodiment in FIG. 1, the obstructing member 52 is a rigid nipple while the front wall 40 is flexible. The front downstream dispensing opening 32 has a substantially punctiform shape and is arranged in the middle part of the front wall 40 which is in contact with the obstructing element 52. Thus, the obstruction of this front dispensing downstream opening 32 is particularly clean when the passage 30 passes from the compressed state to the rest state, which prevents a superfluous amount of content 12 from flowing unintentionally from the front downstream dispensing opening 32 after use.

It should be pointed out, however, that other variant embodiments could be envisaged, where the obstructing member 52 is flexible and the front wall 40 is rigid or where the obstructing member is in the shape of a plate not a nipple.

In the embodiment in FIG. 1, the obstructing member 52 forms the terminal portion of a shaft means 54 arranged in the axial direction, meaning in the longitudinal axial direction of the container means 14 and of the conveying means 26. This obstructing member 52 is located on the upstream internal side of the front wall 40, without protruding outside the device 10 through the front downstream dispensing opening 32. The presence of this obstructing member therefore does not interfere with the application of the content 12 onto the receiving area, nor does it bother the user.

In an alternative embodiment (not represented), the front downstream dispensing opening 32 can have a shape complementary to that of the obstructing member 52 so that when it is closed it does not to leave any recess that could retain some of the product 12 and thus expose it to oxidation or bacterial contamination.

The container means 14 and the shaft means 54 are parts of one piece, arranged axially in the longitudinal axial direction. The container means 14 and the shaft means 54 are arranged each as an extension of the other, at the front portion of the container means 14 and at the rear base of the shaft means 54.

The container means 14 is larger in size radially than the shaft means 54. A transverse shoulder 56 in which is arranged the downstream opening 16 of the container means 14 then connects the front portion 14*a* of this container means 14 and the rear base of the shaft means 54.

In this embodiment, the passage 30 of the conveying means 26 has a transverse cross-section that is annular in shape, delimited by an enclosed outside contour corresponding to the side wall 48 and an enclosed inside contour corresponding to the shaft means 54.

It should be noted that the first embodiment illustrated in FIG. 1 is advantageous because it allows, due to the use of the obstructing member 52 and the shaft means 54 in particular, giving an appropriate shape to the side wall 48 and to the front wall 40 while assuring proper obstruction of the front downstream dispensing opening 32.

However, in an alternative embodiment (not represented), the downstream valve means can be formed by the front wall 40 where the front downstream dispensing opening 32 is located, with no need for an obstructing member 52 or a shaft means 54. In this case, it is advisable that the front wall 40 have sufficient elasticity to assure the closing of the front downstream dispensing opening 32 when there is no external force applied or negative pressure upstream, and to assure the opening of this front downstream dispensing opening 32 when there is positive pressure upstream.

In this case, the passage 30 of the conveying means 26 then presents a transverse cross-section delimited only by an enclosed outside contour corresponding to the side wall 48.

Although they are part of the same dispensing and application member 50, the side 48 and front 40 walls can correspond to two distinct parts—connected directly or indirectly—of this dispensing and application member 50 or alternative can form a single piece.

The combined device for packaging, dispensing, and application 10 also comprises an initial protection means and/or an initial integrity verification means (not represented).

The initial protection means, positioned over the front downstream dispensing opening 32, corresponds for example to a self-adhering protective strip which prevents content 12 from being released through this front downstream dispensing opening 32.

The initial integrity verification means, also positioned over the front downstream dispensing opening, corresponds in another example to a strip adjoining the outside face 42 of the front wall 40 and having perforations which must be torn in order to detach this strip prior to first using the device.

The combined device for packaging, dispensing, and application 10 also comprises a part serving as a basic body 58 in which is housed and to which is attached the container means 14.

For this purpose, the part serving as a basic body 58 and the container means 14 have rigid mutual association means which maintain them in their mutual positions relative to one another. The rigid mutual association means 60 of FIG. 1 are achieved by clamping but could also be snapped into place, screwed into place, or similar.

The combined device for packaging, dispensing, and application 10 additionally comprises a cap means 62 which can be detachably assembled onto the container means 14 or onto the part serving as a basic body 58.

For this purpose, the part serving as a basic body 58 and the container means 14 have rigid mutual association means which maintain them in their mutual positions relative to one another. The rigid mutual association means 60 of FIG. 1 are achieved by clamping but could also be snapped into place, screwed into place, or similar.

It should be noted that, in this first embodiment, the combined device for packaging, dispensing, and application 10 of the invention integrates a part comprising the container means 14 and the shaft means 54, arranged axially each as an extension of the other, at the front portion 14*a* of the container means 14 and at the rear base of the shaft means 54.

This part is formed of a single piece and performs several functions simultaneously, which simplifies the construction of the device and therefore the corresponding production costs.

It is also possible to use several distinct and independent parts and assemble them together.

Figure 3A:
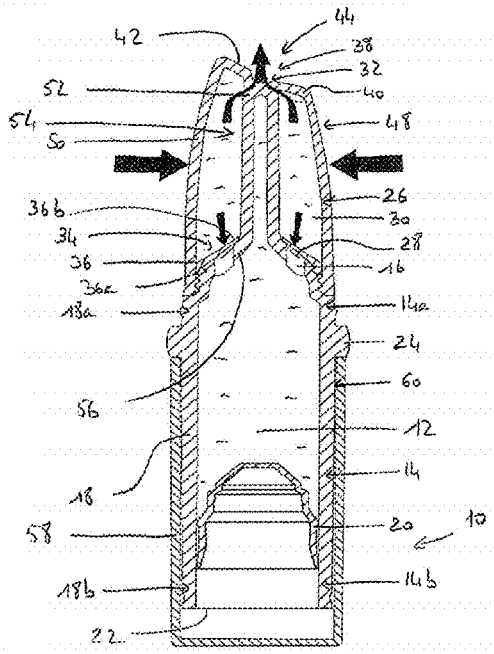
Figure 3B:
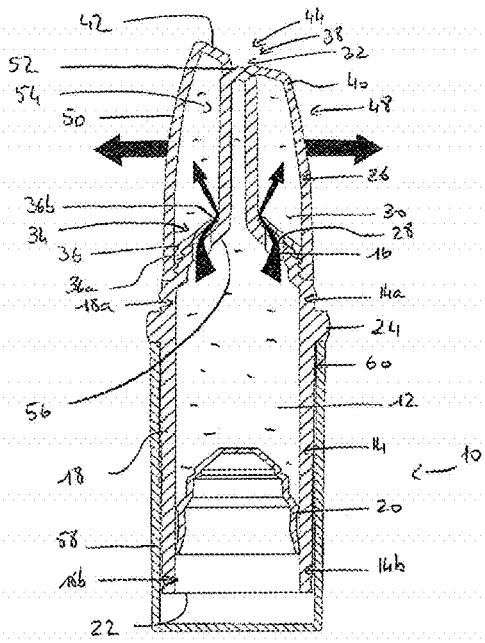

The process by which the dispensing and application member 50 of the combined device for packaging, dispensing and application 10 of the invention passes from the rest state to the compressed state is illustrated in FIGS. 3*a* and 3*b*.

It is clear from FIG. 3*a* that, when the dispensing and application member 50 is compressed in order to pass from the rest state to the compressed state, the positive pressure generated in the conveying means 26 causes the annular ring 36 to close over the downstream opening 16 and thus to obstruct this downstream opening 16. The content 12 contained in the conveying means 26 then cannot enter the container means 24. This content is therefore inevitably conveyed towards the front downstream dispensing opening 32 and is discharged to the outside.

It is also clear from FIG. 3*b* that, when the dispensing and application member 50 is released in order to pass from the compressed state to the rest state, the negative pressure generated in the conveying means 26 causes the annular ring 36 to detach from the downstream opening 16 of the tubular part 18 and therefore opens the upstream valve means 34. Part of the content 12 contained in the container means 14 then travels through the downstream opening 16 of the tubular part in order to enter the conveying means 26. Conversely, at the same time the front downstream dispensing opening 32 remains pressed against the obstructing member 52 which prevents any air from entering.

To dispense and apply content onto a receiving area using the combined device for packaging, dispensing, and application of the invention, the following steps should be executed.

First, an assembly is provided in which the container means 14 is filled with content 12, the upstream valve means 34 and the downstream valve means 38 are respectively closing off the communication between the container means 14 and the passage 30 of the conveying means 26 and the front downstream dispensing opening 32.

To dispense and apply content onto the receiving area, the contact and application area 44 of the front wall 40 of the device 10 is brought into contact with and applied against the receiving area. While the device 10 is so positioned it allows the user to press his or her fingers on the side wall 48/the actuating means 46 with the appropriate pressure to dispense the desired dose of content through the dispensing opening 32 and simultaneously apply it onto the receiving area.

For this purpose, the actuating means 46 is biased by the fingers pressing on the elastically deformable side wall 48, such that the internal volume of the passage 30 passes from the maximum volume to a smaller internal volume.

This closes the upstream valve means 34 and opens the downstream valve means 38, causing the content 12 to exit through the front downstream dispensing opening 32.

The outside face 42 of the front wall 40 in contact with and pressing against the receiving area of the support allows applying the content onto the receiving area and, where necessary, the outside face 42 of the front wall 40 and the front downstream dispensing opening 32 are moved over the receiving area according to the pattern desired for the applied content.

Then the user stops exerting pressure on the movable actuating means 46 and the elastically deformable side wall 48 is allowed to return to its initial state.

This closes the downstream valve means 38 which stops the discharge of content 12 through the front downstream opening 32 for dispensing content 12, and opens the upstream valve means 34 so that an amount of content 12 equivalent to that which was distributed through the front downstream dispensing opening 32 is transferred from the container means 14 to the conveying means 26 due to the negative pressure generated.

The implementation of the device 10 described above creates a significant area of contact for the fingers and allows a resulting deformation of the side wall 48/actuating means 46 that creates, upstream of the dispensing opening 32, a positive pressure which exceeds the pressure exerted in the opposite direction downstream of the dispensing opening 32 due to the contact and manual pressure of the device 10 against the support in the receiving area.

FIGS. 4*a* to 4*d* represent four detailed front views of four variants of the dispensing and application member 50 which can be used in the first embodiment of the combined device for packaging, dispensing, and application 10 of FIG. 1.

It can be seen from these figures that said dispensing and application member 50 may, depending on the case shown in the figures, provide only partial access to the side wall 48 forming the movable actuating means 46. The partial access will advantageously have an outwardly curving shape.

Figure 4A:
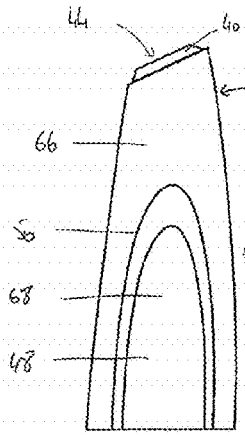
Figure 4B:
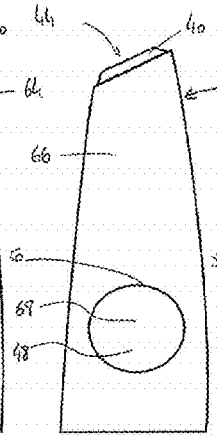
Figure 4C:
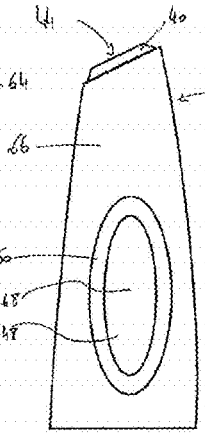
Figure 4D:
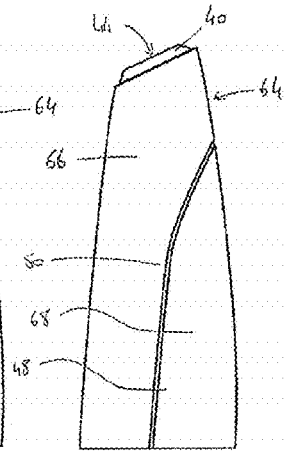

Note that it is possible to have a rigid protective part 64 partially covering the side wall 48, either for aesthetic reasons or to protect this side wall 48. This is what is represented in FIGS. 4*a* and 4*c*.

The rigid protective part 64 can be of metal or plastic, which—in addition to the aesthetic aspect—allows stiffening a portion of the dispensing and application member 50 to increase the force of the return to the initial state of the elastically deformable side wall 30 and therefore to increase the "power" of the pumping action.

In one variant, it is also possible for the side wall 48 itself to have an extended protective portion 66 having a rigid extra thickness and a limited movable portion 68 forming the movable actuating means 46.

FIGS. 5*a* to 5*d* represent perspective views of four different embodiments, each of a combined device for packaging, dispensing, and application 10 of the invention.

It can be seen from these different representations that the container means 14, the dispensing and application member 50, the shaft means 54, the basic body 58, and the cap means 62 of the combined device for packaging, dispensing, and application 10 of the invention can have various geometries, varying in length or width according to the application.

FIGS. 5*e* to 5*h* represent perspective views of four different embodiments of the container means 14.

Figure 5A:
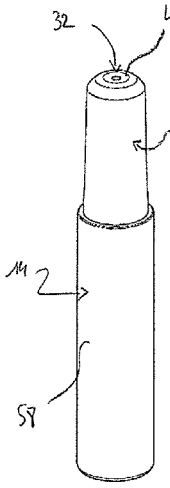
Figure 5B:
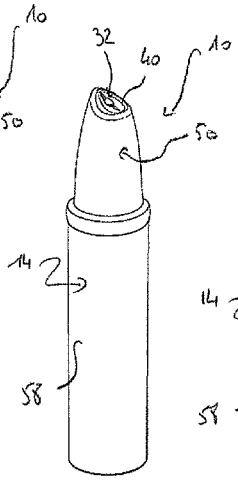
Figure 5C:
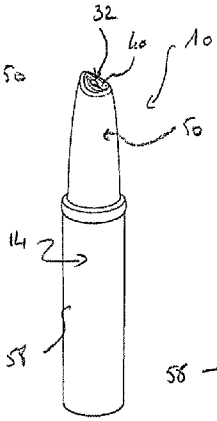
Figure 5D:
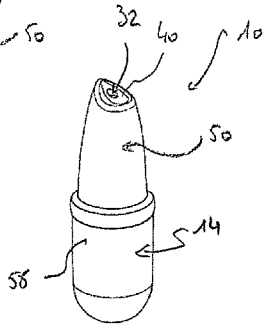
Figure 5E:
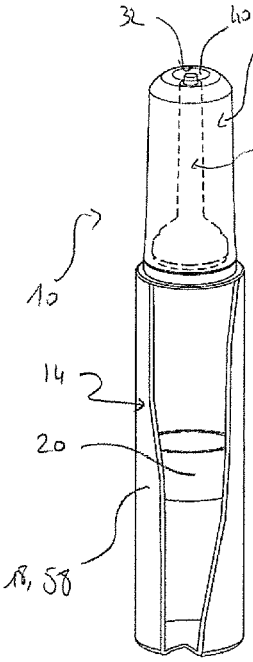

In FIG. 5*e*, the container means 14 comprises a rigid tubular part 18—here having a substantially circular cross-section—also serving as the basic body 58, and a piston 20 mounted inside the rigid tubular part 18, between them being fluidtight to the content 12 as described above.

Figure 5F:
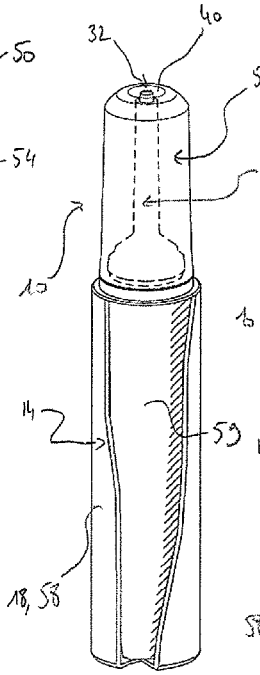

In FIG. 5*f*, the container means 14 comprises a rigid tubular part 18 which here again serves as a basic body 58, and a flexible pouch 59 of which the inside volume decreases as the content 12 is used. An aperture in the rigid part (not represented) allows reestablishing the atmospheric pressure between the rigid tubular part 18 and the flexible envelope as the volume of the latter decreases.

Figure 5G:
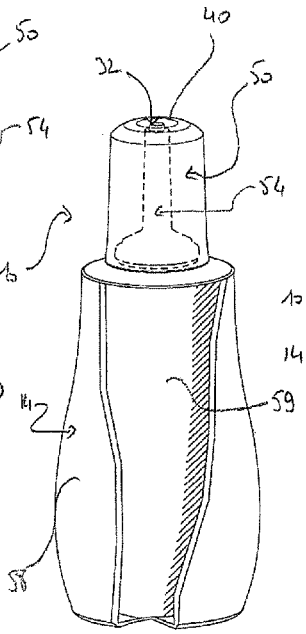

In FIG. 5*g*, the container means 14 consists of a bottle made of multilayer coextruded plastic, referred to as a bottle with internal bag, of which the outer layer forms a rigid shell serving as the basic body 58 and the inside layer forms a flexible pouch 59 of which the inside volume decreases as the content 12 is used. An aperture in the rigid shell (not represented) allows reestablishing the atmospheric pressure between the rigid shell serving as the basic body 58 and the flexible pouch 59 as the volume of the latter decreases.

Figure 5H:
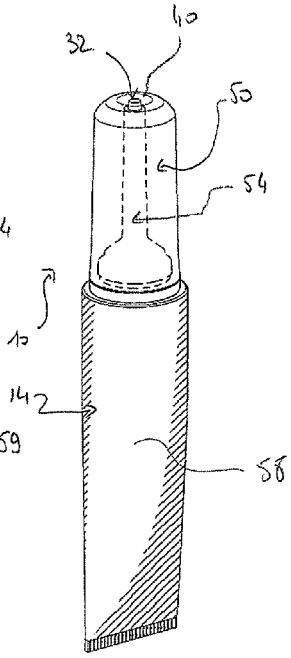

In FIG. 5*h*, the container means 14 is a flexible plastic tube serving as the basic body 58, which can progressively flatten as the content 12 is used.

FIGS. 5*i* to 5*l* represent perspective views of four distinct embodiments of the dispensing and application member 50.

Figure 5I:
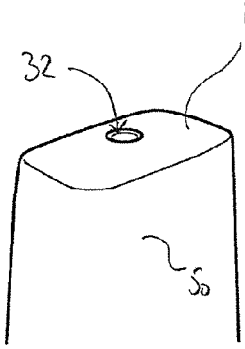

In FIG. 5*i*, the dispensing and application member 50 has a cross-section and a front surface area 40 of large dimensions as well as a front downstream dispensing opening 32 that is relatively large, which allows expelling a relatively large amount of content 12 and applying this content over an extensive area.

Figure 5J:
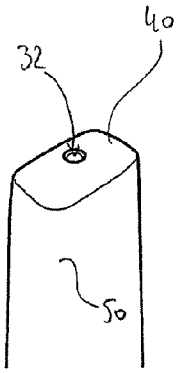

In FIG. 5*j*, the dispensing and application member 50 has a cross-section and a front surface area 40 of intermediate dimensions as well as a front downstream dispensing opening 32 that is relatively narrow. This allows precisely dosing the content and applying it over an area of intermediate size.

Figure 5K:
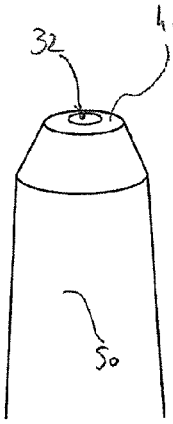

In FIG. 5*k*, the end of the dispensing and application member 50 has the shape of a truncated cone with a significant difference in volume radially, such that the cross-section of the side wall 48 is large but the front downstream dispensing opening 32 is relatively narrow.

Figure 5L:
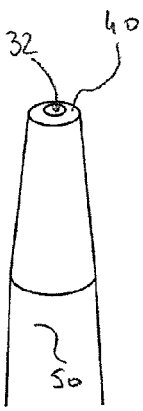

In FIG. 5*l*, the end of the dispensing and application member 50 has the shape of a truncated cone with a small difference in volume radially, such that the cross-section of the side wall 48 is only slightly larger than the front downstream dispensing opening 32. This allows precise application of the content 12 onto an area of small size.

Figure 5M:
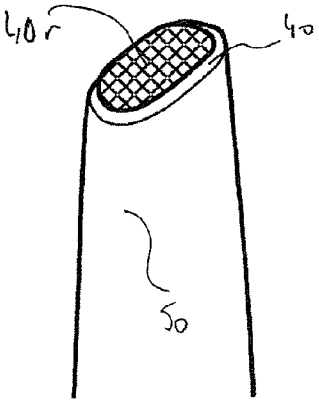
Figure 5N:
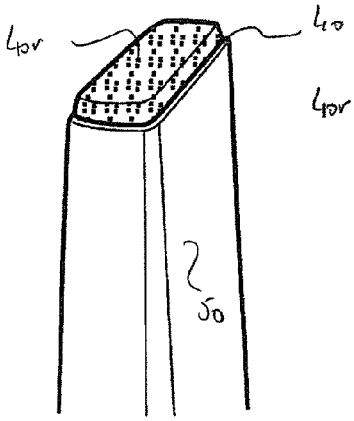
Figure 5O:
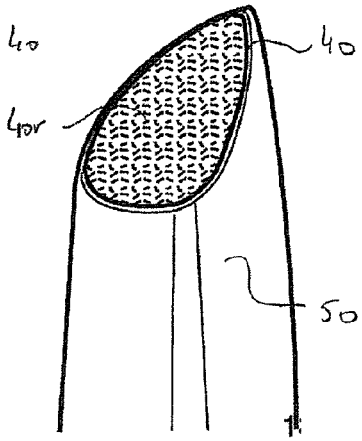

FIGS. 5*m* to 5*o* represent perspective views of three distinct embodiments of the dispensing and application member 50, in which the front surface 40 is covered with a surface coating 40r to achieve a particular application of the content 12.

In the embodiments, these surface coatings 40r can be made of foam, cloth, etc., or by treating the front surface 40.

Figure 5P:
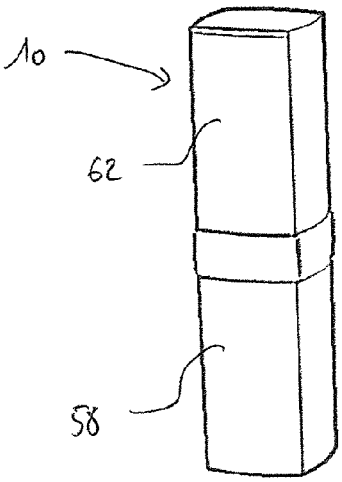
Figure 5Q:
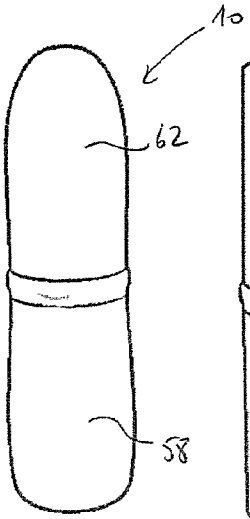
Figure 5R:
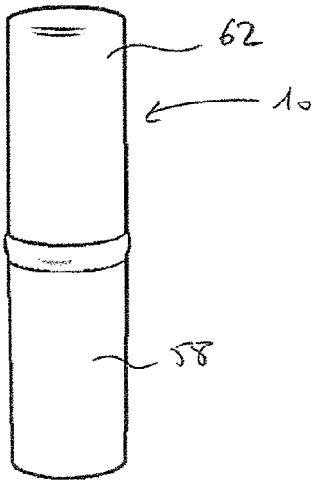

FIGS. 5*p* to 5*r* represent three non-limiting example embodiments of the combined device for packaging, application, and dispensing 10 of the invention, in substantially different shapes.

A second embodiment of the combined device for packaging, dispensing, and application 100 according to the invention is now described.

Figure 6:
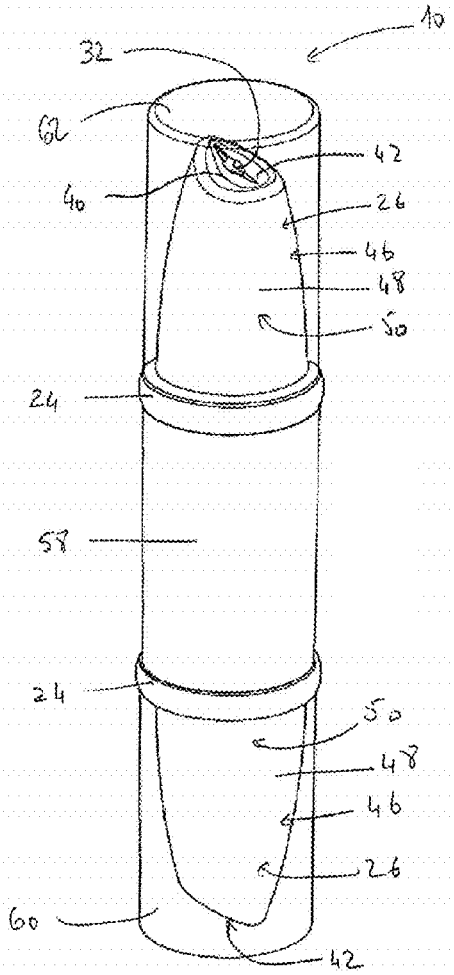
FIG. 6 is a general view of the assembly, in a perspective view, of a second embodiment of the combined device for packaging, dispensing, and application, comprising two basic devices of the invention arranged end to end, the two container means being adjacent and the two front downstream dispensing openings being opposite each other.
Figure 7:
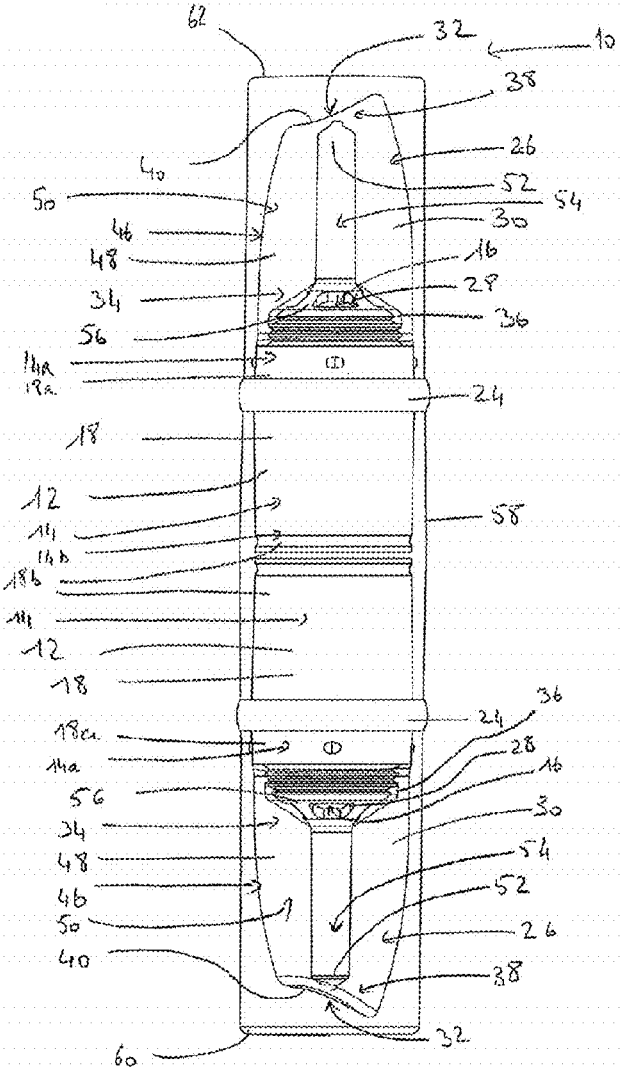
FIG. 7 is a general view of the assembly, in a partial cross-section, its transparency illustrating the second embodiment of the combined device for packaging, dispensing, and application of FIG. 6.

This second embodiment, represented in FIGS. 6 and 7, comprises two basic devices 10 that are identical to the first embodiment of the combined device for packaging, dispensing and application.

More specifically, these two basic devices 10 are placed end to end in opposing directions, with the two container means 14 being adjacent and the two front downstream dispensing openings 32 for the two contents 12 being opposite one another.

These two basic devices differ from the first embodiment of the combined device for packaging, dispensing, and application 10 only in that the two of them share a single basic body 58 in which is housed and to which are attached the two container means 14.

A third embodiment of the combined device for packaging, dispensing, and application 210 according to the invention is now described.

This third embodiment is illustrated by FIGS. 8, 9, 10*a*, and 10*b*.

This third embodiment of the combined device for packaging, dispensing, and application 210 is intended for the packaging, dispensing, and application of at least two contents 212, 212' of a liquid to pasty consistency.

It should be stressed, however, that similar embodiments could also allow packaging, dispensing, and applying more than two distinct contents 212, 212'.

The combined device for packaging, dispensing, and application 210 comprises, firstly, two container means 214, 214' extending substantially in a longitudinal axial direction and each comprising a front portion 214*a*, 214*a'* and a rear portion 214*b*, 214*b'*.

These two container means 214, 214' are adjoining each other in a manner that forms a single piece, but are distinct and hermetically separated from each other by a fluidtight compartment means 215. The container means 214, 214' are able to hold predetermined amounts of contents 212, 212' under fluidtight conditions while appropriately containing said contents 212, 212' relative to each other and to the outside.

The front portions 214*a*, 214*a'* of the container means 214, 214' are fitted with a downstream opening 216, 216' sufficiently large to allow the passage of the contents 212, 212'. The container means 214, 214' are arranged so that an amount of content 212, 212' exiting through the respective downstream opening 216, 216' is compensated for with no admission of air.

To do this, the container means 214, 214' each comprise a rigid tubular part 218, 218'—here having a substantially semi-circular cross-section—and a piston 220, 220' mounted inside each of the tubular parts 218, 218' and assuring fluidtight containment of the contents 212, 212'.

Each piston 220, 220' has a shape and composition which allow it to move from a rear portion 218*b*, 218*b'* towards a front portion 218*a*, 218*a'* of the corresponding tubular part 218, 218' as the content 12, 12' escapes.

The rear portion 218*b*, 218*b'* of each of the tubular parts 218, 218' has an open rear edge 222, 22' through which the pistons 220, 220' can be introduced. When these pistons 220, 220' are in position inside the tubular parts 218, 218', they assure the fluidtight containment of the contents 212, 212' and prevent these contents from escaping via the rear edges 222, 222' of the tubular parts 218,218'.

The combined device for packaging, dispensing, and application 210 also comprises two conveying means 226, 226', again separated by a fluidtight compartment means 227.

The two conveying means 226, 226' extend out from the front portion 214*a*, 214*a'* of the container means 214, 214' and each comprises an upstream opening 228, 228', a passage 230, 230' extending axially in the longitudinal axial direction, and a front downstream dispensing opening 232, 232'.

Each passage 230, 230' is elastically deformable and can be in a rest state with a maximum internal volume or in a compressed state with a minimum internal volume. The change from the rest state to the compressed state of a passage 230, 230' causes a positive pressure in the corresponding conveying means 226, 226' while the passage from the compressed state to the rest state of a passage 230, 230' results in a negative pressure in the corresponding conveying means 226, 226'.

The combined device for packaging, dispensing, and application 210 also comprises two upstream valve means 234,234'.

The two upstream valve means 234, 234' are placed between the downstream openings 216, 216' of the container means 214, 214' and the upstream openings 228, 228' of the conveying means 226, 226'. These upstream valve means 234, 234' prevent the transfer of content 212, 212' from the conveying means 226, 226' to the container means 214, 214', particularly when the passage 230 passes from the rest state to the compressed state. In addition, said upstream valve means 234, 234' are able to deform and thus unobstruct the downstream openings 216, 216' and allow the contents 212, 212' to travel from the container means 214, 214' to the conveying means 226, 226' when these passages 230, 230' pass from the compressed state to the rest state and thus generate a negative pressure in the conveying means 226, 226'.

In the embodiment in FIG. 8, the upstream valve means 234, 234' consist of an upstream valve part 236 made of a flexible material. This upstream valve part 236 comprises two covering portions 236*a*, 236*a'* able to completely cover the upstream openings 228, 228' of the conveying means 226, 226' in order to prevent the transfer of content 212, 212' from these conveying means 226, 226' to the corresponding container means 214, 214'. This upstream valve part 236 also comprises an open passage 237 able to cooperate with the fluidtight compartment means 227 in a manner that does not compromise the fluidtightness between the two conveying means 226, 226'.

The combined device for packaging, dispensing, and application 210 also comprises two downstream valve means 238, 238'.

These downstream valve means 238, 238' are associated with the front downstream dispensing openings 232, 232' and allow the extraction of the contents 212, 212' respectively accumulated in the two passages 230, 230' of the two conveying means 226, 226' when these means change from the rest state to the compressed state, thus generating a positive pressure.

In effect, when one of the two passages 230, 230' passes from the rest state to the compressed state, the corresponding upstream valve means 234, 234' prevents the content 212, 212' from passing through the upstream opening 228, 238' of the conveying means 226, 226' to enter the corresponding container means 214, 214'. The content 212, 212' is then inevitably guided into moving towards the front downstream dispensing opening 232, 232' for discharge to the outside.

It should be noted that, in this embodiment, it is possible to cause only one of the two passages 230, 230' to pass from the rest state to the compressed state and thus generate only the release of the corresponding content 212, 212'. The two passages 230, 230' can thus be manipulated independently of each other to generate a mixture of the two contents 212, 212'.

The combined device for packaging, dispensing and application 210 also comprises a front wall 240.

This front wall 240 bears the two front downstream dispensing openings 232, 232'. This front wall 40 is thus intended to come into contact with the receiving area onto which the contents 212, 212' exiting the front downstream dispensing openings 232, 232' are deposited. To achieve this, the front wall 240 extends transversely to the longitudinal axial direction and has an outside face 242 forming a contact and application area 224 of the device.

As in the above example embodiments, the implementations of this front wall 240 can be adapted for the use that is to be made of them, particularly in order to facilitate a specific and optimized application of the contents 212, 212' onto their receiving area.

The combined device for packaging, dispensing and application 210 also comprises two movable actuating means 246, 246'.

The two movable actuating means 246, 246' are associated with the passages 230, 230' of the conveying means 226, 226', and respectively cause said passages 230, 230' to pass from the rest state to the compressed state and vice versa, to force the release of the contents 212, 212' through the corresponding front downstream dispensing openings 232, 232'.

More particularly, the movable actuating means 246, 246' consist of a single elastically deformable side wall 248 laterally and externally delimiting the passages 230, 230' of the two conveying means 226, 226'. Thus when the side wall 248 is compressed, it is elastically deformed which causes one or the other of the passages 230, 230' to pass from the rest state to the compressed state, at the same time generating a positive pressure inside one or the other of the conveying means 226, 226' and therefore the release of the corresponding contents 212, 212' to the outside. Conversely, when this side wall 248 is released, it returns elastically to its rest state, at the same time generating a negative pressure inside one or the other of the conveying means 226, 226' and therefore closing the corresponding downstream valve means 238, 238'.

As was true for the embodiments described above, the side wall 248 is annular, which makes the combined device for packaging, dispensing and application 210 quite comfortable to manipulate.

The side wall 48 is external to the conveying means 226, 226' and at least partially constitutes an external side wall of the combined device for packaging, dispensing, and application 210, at least accessible for the actuation. The user can therefore easily and freely access the movable actuating means 246, 246' to cause one or the other of the contents 212, 212' to be expelled through the front downstream dispensing opening 232, 232'.

In addition, the side wall 248 and the front wall 240 are part of a same content 212 dispensing and application member 250 which comprises, towards the rear, the upstream openings 228, 228' of the conveying means 226, 226'.

Because of this particular arrangement, the number of parts and therefore the production costs are decreased, the user's awareness of the amount of content 212, 212' released is improved, and the application of the contents 212, 212' onto the receiving area is improved. In addition, it is possible to adjust the final mixture applied onto the receiving area by actuating one or the other of the movable actuating means 246, 246' to a greater or lesser extent in order to increase the released amount of one of the contents 212, 212' relative to the other.

In the example embodiment of FIG. 8, the downstream valve means 238, 238' comprise two obstructing members 252, 252' respectively cooperating with the two front downstream dispensing openings 232 arranged in the front wall 240.

In order to facilitate the release of the contents 212, 212' through these front downstream dispensing openings 232, 232', among the obstructing members 252, 252' and the front wall 40 one has a certain flexibility and the other a certain rigidity.

In this case, the obstructing members 252, 252' are rigid nipples while the front wall 240 is flexible. The front downstream dispensing openings 232, 232' are substantially punctiform and are arranged substantially in the middle part of a half-region of the front wall 240 so that they come into contact with the obstructing members 252, 252'. Thus, the obstruction of these front downstream dispensing openings 232, 232' occurs in a particularly clean manner when one or the other of the passages 230, 230' passes from the compressed state to the rest state, which prevents superfluous content 212, 212' from inadvertently flowing from the front downstream dispensing opening 232 after use.

In the embodiment in FIG. 8, the obstructing members 252, 252' form the terminal part of the two stems 253, 253' attached to each side of a partitioning means 254 arranged in the axial direction, meaning in the longitudinal axial direction of the container means 214, 214' and conveying means 226, 226'.

These obstructing members 252, 252' are positioned on the upstream internal side of the front wall 240, without protruding through the front downstream dispensing openings 232, 232' towards the outside of the combined device for packaging, dispensing, and application 210. Thus, the presence of the obstructing member 252, 252' does not in any way alter the application of the contents 212, 212' onto the receiving area, nor does it bother the user.

In an alternative embodiment (not represented), the front downstream dispensing openings 232, 232' can have a shape complementary to that of the obstructing members 252, 252' so that no recess remains when in the closed position which could retain some of the products 212, 212' and thus expose them to oxidation or contamination.

The two container means 214, 214' and the partitioning means 254 are parts of a same piece arranged axially in the longitudinal axial direction. The container means 214, 214' and the partitioning means 254 are each arranged as an extension of the other, at the front portion 214*a*, 214*a'* of the container means 214, 214' and at the rear base of the partitioning means 254.

The two container means 214, 214' are, together, larger in size radially than the width of the partitioning means 254. Two transverse shoulders 256, 256' in which are arranged the two downstream openings 216, 216' of the container means 215, 214' then connect the front portions 214, 214' of these container means 214, 214' and the rear base of the partitioning means 254.

In this embodiment, the two passages 230, 230' of the conveying means 226, 226' have a transverse cross-section that is semi-annular in shape, delimited by an enclosed contour corresponding on the one hand to the side wall 248 and on the other hand to the partitioning means 254. Here, the partitioning means 254 and the side wall 248 have fluidtight mutual association means which establish a completely hermetic compartmentalization between the two passages 230, 230'.

It should be pointed out that such an embodiment is advantageous because it gives, due to the use of obstructing members 252, 252' and partitioning means 254, an appropriate shape to the side wall 258 and to the front wall 240 while providing good obstruction of the front downstream dispensing openings 232, 232' and sufficient fluidtightness between the conveying means 226, 226'.

However, in an alternative embodiment (not represented), the downstream valve means 238, 238' can be formed by the front wall 240 where the front downstream dispensing openings 232, 232' are located, without requiring the use of obstructing members 252, 252' or a partitioning means 254 extending from the container means 214, 214'. In this case, the front wall 40 should have sufficient elasticity to ensure the closing of the front downstream dispensing openings 232, 232' when there is no external force applied or negative pressure upstream, and the opening of these front downstream dispensing openings 232, 232' when there is positive pressure upstream. The dispensing and application member 250 should also be equipped with an internal partitioning wall to separate and assure adequate fluidtightness between the two conveying means 226, 226'.

Also, although they are part of the same dispensing and application member 50, the side 248 and front 240 walls can correspond to two parts of this dispensing and application member 250 or alternatively can form a single piece.

The combined device for packaging, dispensing, and application 210 also comprises an initial protection means and/or an initial integrity control means (not represented).

The initial protection means, positioned over the front downstream dispensing openings 232, 232', corresponds for example, to one or more self-adhering protective strips which prevent content 212, 212' from being released through these front downstream dispensing openings 232, 232'.

The initial integrity control means, also positioned over the front downstream dispensing openings 232, 232', corresponds in another example to one or more strips adjoining the outside face 242 of the front wall 240 and having perforations which must be torn in order to detach these strips prior to first using the device.

The combined device for packaging, dispensing, and application 210 also comprises a part serving as a basic body 258 in which is housed and to which is attached the container means 214, 214'.

For this purpose, the part serving as a basic body 258 and the container means 214, 214' have rigid mutual association means 260 which maintain them in their mutual positions relative to one another.

The combined device for packaging, dispensing, and application 210 additionally comprises a cap means 262 which can be detachably assembled onto the container means 214, 214' or onto the part serving as a basic body 258.

Three methods for creating an assembly comprising the first embodiment of the combined device for packaging, dispensing, and application 10 of the invention and the content 12 are now described.

These three methods are illustrated in FIGS. 11*a*, 11*b*, and 11*c*.

In a first embodiment, represented in FIG. 11*a*, a device 10 is provided in which the part comprising the container means 14, without the piston 20, and the content 12 dispensing and application member 50 are assembled together. Then, the container means 14 is filled with content 12 through its rear opening 22. Next, some of this content 12 is transferred from the container means 14 to the content dispensing and application member 50 by forcing open the upstream valve means 34 due to positive pressure on the content 12 or negative pressure in the front dispensing opening 32. Then the filling of the container means 14 with content 12 is completed. Lastly, the piston 20 is placed in the container means 14.

In a second embodiment represented in FIG. 11*b*, a device 10 is provided in which the part comprising the container means 14, without the piston 20, and the content 12 dispensing and application member 50 are assembled together. Then, the content 12 dispensing and application member 50 is filled with content 12 by forcing open the upstream valve means 34 due to positive pressure on the content 12 or negative pressure in the front dispensing opening 32. Then the container means 14 is filled with content 12 by its open rear edge 22. Next, once the filling of the container means 14 is completed, the piston 20 is placed in the container means 14.

In a third embodiment represented in FIG. 11*c*, a device 10 is provided in which the part comprising the container means 14, without the piston 20, and the content 12 dispensing and application member 50 are assembled together. The container means 14 is filled with content 12 by its rear opening 22. Next, the piston 20 is placed in the container means 14. Then the piston 20 is pushed into the container means 14 so that the content 12 dispensing and application member 50 is filled with content 12 by forcing open the upstream valve means 34 due to the positive pressure on the content 12 generated by the advance of the piston 20.

It should be noted that in the first two methods illustrated in FIGS. 11*a* and 11*b*, the placement of the piston 20 can be replaced by pouring melted wax to form a wax plug. Once solidified, the wax plug behaves like a piston 20. This option is particularly suitable for a container means 14 having a non-circular cross-section where it is difficult to establish a fluidtight seal.

As indicated above, the application, packaging, and dispensing device 10, 210 of the invention can be used in different technical fields.

FIG. 12*a* illustrates an example application where the application, packaging, and dispensing device 10, 210 is used as lipstick, lip gloss, chapstick, etc.

FIG. 12*b* illustrates another example application where the application, packaging, and dispensing device 10, 210 is used for local application of the content 12, 212, 212' onto the skin for functional purposes (insect bites, dermatology applications, acne, etc.).

FIG. 12*c* illustrates another example application where the application, packaging, and dispensing device 10, 210 is used to apply glue or corrective whiteout onto a sheet of paper, for example.

FIG. 12*d* illustrates an example application in which the application, packaging, and dispensing device 10, 210 is used in the do-it-yourself field, for example to apply grease onto a bicycle chain or for some other application.

The invention claimed is:

1. A device, having a general axis (AA), for packaging and dispensing (10, 210) of a fluid content (12, 212, 212') of liquid to pasty consistency, comprising:

a content container (14, 214, 214') comprising a front portion (14*a*, 214*a*) provided with a downstream opening (16, 216, 216');

a content (12, 212, 212') conveying means (26, 226, 226'), extending from the front portion (14*a*, 214*a*) of the content container (14, 214, 214'), comprising an upstream opening (28, 228, 228'), an axially extending passage (30, 230, 230'), and a front downstream opening (32, 232, 232') for dispensing the fluid content (12, 212, 212'), the axially extending passage (30, 230, 230') being elastically deformable between a rest state having a maximum internal volume and a compressed state having a smaller internal volume;

an upstream valve (34, 234, 234'), located between the downstream opening (16, 216, 216') of the content container (14, 214, 214') and the upstream opening (28, 228, 228') of the conveying means (26, 226, 226');

a downstream valve (38, 238, 238') comprising an obstructing member (52, 252, 252'), associated with the front downstream dispensing opening (32, 232, 232'); and a content dispensing member (50, 250), comprising a front wall (40, 240, 240') and an elastically deformable side wall (48, 248, 248'), a rearward end of the content dispensing member (50, 250) forming the upstream opening (28, 228, 228') and the front wall (40, 240, 240') of the content dispensing member (50, 250) having an outside face (42) opposite the rearward end of the content dispensing member (50, 250) and extending in a generally transversal direction wherein is located the front downstream opening (32, 232, 232'), the content dispensing member (50, 250) being configured to dispense, via the front downstream opening (32, 232, 232'), the fluid content when the content dispensing member (50, 250) is placed in contact with and applied against, with pressure, a receiving area of a support onto which the fluid content exiting the front downstream dispensing opening (32, 232, 232') is deposited, where during a dispensing operation, the outside face (42) of the front wall (40, 240, 240') remains free and accessible for said receiving area, is in contact with and pressing against the receiving area of the support for the fluid content to be applied onto the receiving area, and defines a precise location where the fluid content is to be applied, said outside face (42) forming a contact and application area (44), said elastically deformable side wall (48, 248, 248') being distinct from the front wall (40, 240, 240'), located rearwards of the front wall (40, 240, 240'), extending in a generally axial direction, is annular with an enclosed outside contour, laterally delimiting the axially extending passage (30, 230, 230'), and generally cylindrical or pseudo-cylindrical in shape or inscribed within an envelope that is generally cylindrical or pseudo-cylindrical in shape, said elastically deformable side wall (48, 248, 248') configured to be accessible to the user's fingers to be operationally deformed by a squeezing operation upon the elastically deformable side wall (48, 248, 248') by the user's fingers, the content dispensing member (50, 250) configured such that said squeezing operation and a corresponding deformation of the elastically deformable side wall (48, 248, 248') creates, upstream of the dispensing opening (32, 232, 232'), a positive opening pressure which exceeds the pressure exerted in the opposite direction downstream of the dispensing opening (32, 232, 232') when the outside face (42) of the front wall (40, 240, 240') is in contact with and applied against the receiving area for dispensing the fluid content, and the obstructing member (52, 252, 252') is located on the upstream internal side of the front wall (40, 240, 240'), without protruding outside through the front downstream dispensing opening (32, 232, 232'), so as not interfere with the application of the fluid content onto the receiving area.

2. The device according to claim 1, wherein the valve obstructing member (52, 252, 252') cooperates with the front downstream dispensing opening (32, 232, 232') arranged in the front wall (40, 240, 240'), one among the obstructing member (52, 252, 252') and the front wall (40, 240, 240') having a certain flexibility, the other a certain rigidity.

3. The device according to claim 2, wherein the obstructing member (52, 252, 252') of the downstream valve (38, 238, 238') is in the form of a nipple or plate.

4. The device according to claim 2, wherein the obstructing member (52) of the downstream valve (38) is a rigid nipple forming the front terminal portion of a shaft means (52), arranged in the axial direction.

5. The device according to claim 4, wherein the container means (14) and the shaft means (52) are parts of a same piece, being arranged axially each as an extension of the other, at the front portion of the content container (14) and at a rear base (22) of the shaft means (52), the front downstream dispensing opening (32) being substantially punctiform and arranged in the middle part of the front wall (40).

6. The device according to claim 5, wherein the axially extending passage (30) of the conveying means (26) has a transverse cross-section that is annular in shape, delimited by an enclosed outside contour and an enclosed inside contour corresponding to the shaft means (52).

7. The device according to claim 5, wherein the content container (14) is of a larger size radially than the shaft means (52), and wherein a transverse shoulder (56) connects the front portion of the content container (14) and a rear base of the shaft means (52), the downstream opening (16) of the content container (14) being arranged in said transverse shoulder (56).

8. The device according to claim 1, wherein the downstream valve (38, 238, 238') is formed by the front wall (40, 240, 240') where the front downstream dispensing opening (32, 232, 232') is located, the front wall (40, 240, 240') being elastically deformable and able to close the front downstream dispensing opening (32, 232, 232') when there is no external force applied or negative pressure upstream, and to open the front downstream dispensing opening (32, 232, 232') when there is positive pressure upstream.

9. The device according to claim 8, wherein the axially extending passage (30) of the conveying means (26) has a transverse cross-section delimited by an enclosed outside contour.

10. The device according to claim 1, wherein the side wall (48, 248, 248') and the front wall (40, 240, 240') are formed of a single piece.

11. The device according to claim 1, wherein the front wall (40, 240, 240'), in which the contact and application area (44) is located on its outside face (42, 242), and in which is located the front downstream dispensing opening (32, 232, 232'), extends transversely and at an angle to the axis (AA) of the device (10, 210).

12. The device according to claim 1, wherein the outside face (42, 242) of the front wall (40, 240, 240') forming the contact and application area (44, 244) is one of flat or slightly rounded or outwardly concave or outwardly convex, and is any of has raised and recessed relief elements, or can be made to rub, or can be made to have a certain superficial flexibility, or bears a coating or decoration or has been the object of a surface treatment.

13. The device to claim 1, further comprising:

a removable protection means on the outside face (42, 242) of the front wall (40, 240, 240').

14. The device according to claim 1, wherein the front downstream dispensing opening (32) is either substantially punctiform and arranged in the middle part of the front wall (40) or is linear in shape, or comprises several openings, or is formed by the porous structure of the front wall (40, 240, 240').

15. The device according to claim 1, wherein the content container (14, 214, 214') is arranged so that the discharge of an amount of content (12, 212, 212') is compensated for without admitting any air.

16. The device according to claim 1, wherein the content container (14, 214, 214') comprises a rigid tubular part (18, 218, 218'), in particular comprising an open rear edge (22), and comprises a piston mounted in the rigid tubular part (18, 218, 218'), between them fluidtight to the content (12, 212, 212'), the piston (20, 220, 220') being gradually movable from the rear portion to the front portion of the rigid tubular part (18, 218, 218') as the rigid tubular part (18, 218, 218') is emptied of content (12, 212, 212').

17. The device according to claim 1, wherein the content container (14, 214, 214') is formed by a deformable wall.

18. The device according to claim 1, which additionally comprises a part serving as a basic body (58, 258) which houses, and to which is attached, the content container (14, 214, 214'), the part serving as a basic body (58, 258) and the content container (14, 214, 214') comprising rigid mutual association means (60, 260).

19. The device according to claim 1, wherein the content (12, 212, 212') dispensing member (50, 250) and the content container (14, 214, 214') are axially arranged each as an extension of the other, at the front portion of the content container (14, 214, 214') and at the upstream opening (28, 228, 228') of the content (12, 212, 212') conveying means (26, 226, 226'), the content (12, 212, 212') dispensing and application member (50, 250) and the content container (14, 214, 214') comprising rigid mutual association means (60, 260).

20. The device according to claim 1, which additionally comprises a cap means (62, 262) suitable for being detachably assembled onto the content container (14, 214, 214') or onto the part serving as a basic body (58, 258).

21. The device for the packaging, dispensing, and application (10, 210) of two fluid contents (12, 212, 212') of liquid to pasty consistency, comprising two basic devices according to claim 1, arranged either end to end, with the two content containers (14) being adjacent and the two front downstream openings (32) for dispensing the two contents (12) being opposite one another, or arranged side by side in the transverse direction, the at least two content containers (214, 214') and the at least two conveying means (226, 226') being distinct and hermetically separated by fluidtight compartment means (227), the at least two movable actuating means, respectively associated with the passages (230, 230') of the conveying means (226, 226'), consisting of a single elastically deformable side wall (48, 248, 248') laterally and externally delimiting the passages (230, 230') of the at least two conveying means (226, 226').

22. A component part of the device according to claim 1, wherein the content container (14) and a shaft means (52), arranged axially each as an extension of the other, at the front portion of the content container (14) and at a rear base of the shaft means (52), the content container (14) being of larger size radially than the shaft means (52), wherein a transverse shoulder connects the front portion of the content container (14) and the rear base of the shaft means (52), the downstream opening (16) of the content container (14) being arranged in said transverse shoulder.

23. An assembly comprising the device according to claim 1, and an amount of content (12, 212, 212') of liquid to pasty consistency filling the container.

24. A method for making use of an assembly of a combined device for packaging, dispensing, and application (10, 210)/an amount of content (12, 212, 212') according to claim 23, in order to dispense and apply content onto said receiving area, wherein:

an assembly is provided in which the content container (14, 214, 214') is filled with content (12, 212, 212'), the upstream valve (34, 234, 234') and the downstream valve (38, 238, 238') are respectively closing off the communication between the content container (14, 214, 214') and the passage (30, 230, 230') of the content (12, 212, 212') conveying means (26, 226, 226') and the front downstream dispensing opening (32, 232, 232'), and, when one wants to dispense and apply content (12, 212, 212') onto the receiving area, the contact and application area (44) of the front wall (40, 240, 240') of the device (10, 210) is placed in contact with and applied against the receiving area, the actuating means (46, 246, 246') is biased by pressing the fingers on the side wall (48, 248, 248') with the appropriate pressure, such that the internal volume of the passage (30, 230, 230') changes from the maximum volume to a smaller internal volume, the dosed dispensing of the content to be applied occurring as it is applied onto the receiving area, thus closing the upstream valve (34, 234, 234') and opening the downstream valve (38, 238, 238') in a manner that causes the content (12, 212, 212') to exit through the dispensing opening (32, 232, 232') and simultaneously to be applied onto the receiving area, the biasing of the actuating means (46, 246, 246') is stopped by stopping the pressure of the fingers on the side wall (48, 248, 248') which allows the side wall (48, 248, 248') to return to its initial state, thus closing the downstream valve (38, 238, 238') and stopping the content (12, 212, 212') from exiting through the dispensing opening (32, 232, 232') and thus opening the upstream valve (34, 234, 234') which allows an amount of content (12, 212, 212') equivalent to what was dispensed through the dispensing opening (32, 232, 232') to be transferred from the content container (14, 214, 214') to the conveying means (26, 226, 226'), due to the negative pressure generated.

25. A combined device for the packaging, dispensing, and application (10) of a content (12) of liquid to pasty consistency onto a receiving area, comprising:

a content container (14) comprising a front portion (14*a*, 214*a*) provided with a downstream opening (16);

a conveying means (26) for the content (12), extending from the front portion of the content container (14), comprising an upstream opening (28), an axially extending passage (30), and a front downstream opening (32) for dispensing content (12), the axially extending passage (30) being elastically deformable between a rest state having a maximum internal volume and a compressed state having a smaller internal volume;

a upstream valve (34), located between the downstream opening (16) of the content container (14) and the upstream opening (28) of the conveying means (26);

a downstream valve (38) comprising an obstructing member (52), associated with the front downstream dispensing opening (32);

a content dispensing member (50), comprising a front wall (40) and an elastically deformable side wall (48) laterally and externally delimiting the axially extending passage (30), the front wall (40) of the content dispensing member (50) having an outside face (42) opposite the rearward end of the content dispensing member (50) and extending in a generally transversal direction wherein is located the front downstream opening (32), said elastically deformable side wall (48) being distinct from the front wall (40), located rearwards of the front wall (40), extending in a generally axial direction, is annular with an enclosed outside contour, laterally delimiting the axially extending passage (30), and generally cylindrical or pseudo-cylindrical in shape or inscribed within an envelope that is generally cylindrical or pseudo-cylindrical in shape, said elastically deformable side wall (48) configured to be accessible to the user's fingers to be operationally deformed by a squeezing operation upon the elastically deformable side wall (48) by the user's fingers, the content dispensing member (50) configured such that said squeezing operation and a corresponding deformation of the elastically deformable side wall (48) creates, upstream of the dispensing opening (32), a positive opening pressure which exceeds the pressure exerted in the opposite direction downstream of the dispensing opening (32) when the outside face (42) of the front wall (40) is in contact with and applied against a receiving area for dispensing the fluid content, and the obstructing member (52) is located on the upstream internal side of the front wall (40), without protruding outside through the front downstream dispensing opening (32), so as not interfere with the application of the fluid content onto the receiving area;

a part, comprising:

the content container (14) including a rigid tubular part (18) and a piston (20) mounted in the rigid tubular part (18), said tubular part and said piston together being fluidtight to the content (12), the piston (20) being gradually movable from the rear portion to the front portion of the rigid tubular part (18) as the rigid tubular part (18) is emptied of content (12), and a rigid shaft means (52), the content container (14) and the shaft means (52) being arranged axially, each as an extension of the other, at the front portion of the content container (14) and at a rear base of the shaft means (52); and wherein the axially extending passage (30) of the conveying means (26) has a transverse cross-section that is annular in shape, delimited by an enclosed outside contour corresponding to the side wall (48) and an enclosed inside contour corresponding to the shaft means (52).

26. An assembly comprising a combined device for the packaging, dispensing, and application (10) of a fluid content (12, 212, 212') of liquid to pasty consistency onto a receiving area according to claim 25 and an amount of content (12) of liquid to pasty consistency filling the content container.

27. A method for creating an assembly of a combined device for packaging, dispensing, and application (10) +content (12) according to claim 26, wherein:

a device is provided in which the part comprising the content container (14), without the piston (20), and the content (12) dispensing and application (50) member are assembled together, the content container (14) is filled with content (12) through its rear opening, some of this content (12) is transferred from the content container (14) to the content (12) dispensing and application member (50) by forcing open the upstream valve means (34) due to positive pressure on the content (12) or negative pressure in the front dispensing opening (32), then the filling of the content container (14) with content (12) is completed, and then the piston (20) in placed in the content container (14).

28. A method for creating an assembly of a combined device for packaging, dispensing and application (10) +content (12) according to claim 26, wherein:

a device is provided in which the part comprising the content container (14), without the piston (20), and the content (12) dispensing and application member (50) are assembled together, the content (12) dispensing and application member (50) is filled with content (12) by forcing open the upstream valve means (34) due to positive pressure on the content (12) or negative pressure in the front dispensing opening (32), then the content container (14) is filled with content (12) by its open rear edge (22), and then, once the filling of the content container (14) is completed, the piston (20) is placed in the content container (14).

29. A method for creating an assembly of a combined device for packaging, dispensing, and application (10) +content (12) according to claim 26, wherein:

a device is provided in which the part comprising the content container (14), without the piston (20), and the content (12) dispensing and application member (50) are assembled together, the content container (14) is filled with content (12) by its rear opening, then the piston (20) is placed in the content container (14), and then the piston (20) is pushed into the content container (14) so that the content (12) dispensing and application member (50) is filled with content (12) by forcing open the upstream valve means (34) due to the positive pressure on the content (12) that is generated by the advance of the piston (20).

30. The assembly according to claim 23, wherein the content filling the content container is any of a lipstick, a pharmaceutical product or an ointment, a cleansing product, a cleaning product, a smoothing or stripping product, a product for coating, covering, or depositing, a preventive or curative treatment, a decorative product, or a functional product.

31. The device according to claim 1, wherein the elastically deformable side wall forms at least two opposite-facing elastic zones, configured to be deformed by a squeezing action that presses the two opposite-facing zones toward each other.

* * * * *